United States Patent [19]

Valentine

[11] 3,989,371

[45] Nov. 2, 1976

[54] CYCLE-OUT LOGIC FOR A MULTI-MODE COPIER/DUPLICATOR

[75] Inventor: William L. Valentine, Rochester, N.Y.

[73] Assignee: Xerox Corporation, Stamford, Conn.

[22] Filed: Apr. 1, 1975

[21] Appl. No.: 564,171

[52] U.S. Cl. ..... 355/14; 355/8

[51] Int. Cl.[2] ..... G03G 15/00

[58] Field of Search ..... 355/11, 14, 17, 3 R, 355/8

[56] References Cited

UNITED STATES PATENTS

| | | | |
|---|---|---|---|
| 3,737,734 | 6/1973 | Nakamura | 355/14 X |
| 3,791,732 | 2/1974 | Mihalik | 355/14 |
| 3,806,242 | 4/1974 | Reehil | 355/14 |
| 3,848,995 | 11/1974 | Gauronski | 355/14 X |

*Primary Examiner*—R. L. Moses

*Attorney, Agent, or Firm*—Paul Weinstein; Clarence A. Green; James J. Ralabate

[57] ABSTRACT

Apparatus and method for use in a multi-mode copier/duplicator for delaying mode changes in response to operator commands to permit vital copier/duplicator functions to be continued without interruption for the copy in process.

15 Claims, 24 Drawing Figures

BASE LOGIC
300
LATCHES
COIN
DEV
CHARGE
PROG. CLK.
COINGO
BASE EXPOSE
INITIALIZATION CIRCUIT
320
BILLING CIRCUIT
602
318
MASTER COUNTER
600
MOTION SENSING LOGIC
606
JAM LOGIC
608
FAILSAFE TIMER
604
POWER DOWN LOGIC
LDC LOGIC
302

400
402
408
410
406
CHAIN FEED LOGIC

318
PROGRAM COUNTER
405
CYCLE OUT LOGIC

ADAPTIVE FUSER CONTROLLER
306A
FUSER COUNTER 00
01
215
a
b
c
d
LD2
360
330
LD3
LD4
LD5
LD7
330
220
242
362
213
ONE SHOT
Q̄
Q
S̄ LDC EXPOSURE D LATCH
Q
264
214
246
283
299
263
284
LD 20a
L520
LD 20a
342
342
00
L 526
LD2
LD3
LD4
LD5
LD7
01

00 ADD PAPER
01 COINF SET
02 LDC BILLING
161 EXPOF MPX (PRINT DISABLE)
320 INHIBIT INITIALIZATION CIRCUIT
INITIAL
PRINT
162 DEVF MPX
163 LDC DEV BIAS / RESET MPX
164 SCAN MPX
04 DONE L
121M 2:1 PRINT DISABLE MUX
122M 2:1 COINCIDENCE/DEVELOP MUX
123M 2:1 DEVELOP BIAS/MUX
124M 2:1 SCAN SOLENOID MUX
+5VDC
LD2
LD7
LD5
LD4
165
04
360
00
01
LD2
360
330
LD3
LD4
LD5
LD7

06
221
222
284a
L505
111
113
330
L540
09
010
012
013
014
015
L529
L528
016
L526
462
DONE LATCH
S
D
Q
215
a
b
231
281
121
464
L524
217
130
460
466
L520
L525
LD20a
342
L540a
LD17a
LD16
LD13
01
02
03
04
05
06
07
08
09
10
11
12
13
14
15
16

U174
+18VDC
366
U167
U171
EXP. MUX
B
165
MAIN DRIVE MPX
166
FUSER MPX
334
CHARGE MPX
168
06
07 LDC ONE SHOT CLR
08 LDC
09 LDC EXPOF
010 DEV SET LDC
012 LDC 13 + COIN RESET
013 LDC MAS CTR CLR
014 HOME+L
015 PRW INIT+L
016 141 DISABLE
LDC EXT SHUT DN
334
EXP MPX
125M
2:1 EXPOSE MUX
126M
2:1 MAIN DRIVE MUX
127M
2:1 FUSER MUX
128M
2:1 CHARGE MUX
A
B
Y
C
LDC EXPOF
EXPOF
+5VDC
LD3
LD16
330
165
360
362
04
370
328b
328a
LD3
LD16
L542
330
06
09
010
012
013
014
015
016

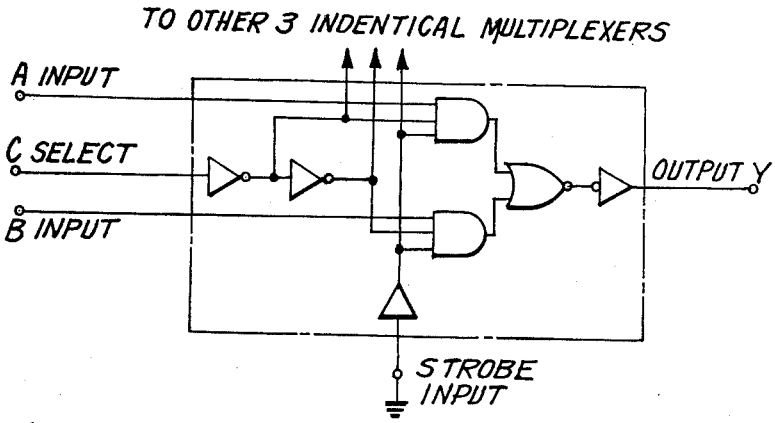

| TRUTH TABLE WITH STROBE GROUNDED | | | |
|---|---|---|---|
| C | A | B | Y |
| H | X | H | H |
| H | X | L | L |
| L | H | X | H |
| L | L | X | L |

X=DON'T CARE (REF.) TEXAS INSTRUMENTS QUAD DATA MUX TYPE SN74157 OR EQUIVALENT

Fig. 16A.

Fig. 16D.

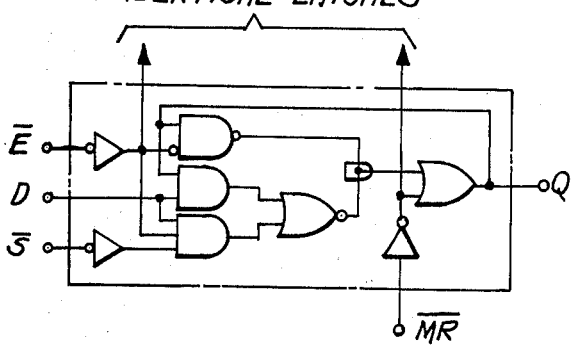

(REF.) FAIRCHILD OR MOTOROLA QUAD LATCH TYPE TTL/MSI 9314 OR EQUIVALENT

| TRUTH TABLE | | | | | |
|---|---|---|---|---|---|
| | INPUT | | | | OUTPUT |
| OPERATION | $\overline{MR}$ | $\overline{E}$ | $\overline{S}$ | D | $Q_n$ |
| D MODE | 1 | 0 | 0 | 0 | 0 |
| | 1 | 0 | 0 | 1 | 1 |
| | 1 | 1 | X | X | $Q_{n-1}$ |
| R/S MODE | 1 | 0 | 0 | 0 | 0 |
| | 1 | 0 | 0 | 1 | 1 |
| | 1 | 0 | 1 | 0 | 0 |
| | 1 | 0 | 1 | 1 | $Q_{n-1}$ |
| | 1 | 1 | X | X | $Q_{n-1}$ |
| DEVICE RESET | 0 | X | X | X | 0 |

| AND | OR | A B | X |
|---|---|---|---|
| A, B → X | A, B → X | H H | H |
| | | H L | L |
| | | L H | L |
| | | L L | L |

Fig. 16B.

| NAND | NOR | A B | X |
|---|---|---|---|
| A, B → X | A, B → X | H H | L |
| | | H L | H |
| | | L H | H |
| | | L L | H |

Fig. 16C.

CYCLE-OUT LOGIC FOR A MULTI-MODE COPIER/DUPLICATOR

CROSS REFERENCE TO RELATED APPLICATIONS

Reference is made to the following prior disclosures in which subject matter relating to the basic mechanical and electrical features of copier/duplicators having fixed and movable optical systems is disclosed as well as the overall operating modes of copier/duplicators having large document copying capabilities: Ser. No. 284,687 filed Aug. 29, 1972, (now abandoned) and continuation application Ser. No. 367,996, filed June 7, 1973; Ser. No. 393,546, filed Aug. 31, 1973, now U.S. Pat. No. 3,900,258, (now abandoned) and continuation application in the name of L. R. Sohn entitled "Dual Mode Control Logic For A Multi-Mode Copier/-Duplicator" filed in November, 1974 (D/73383C). Reference is also made to concurrently filed applications in the name of Thomas J. Mooney entitled "Adaptive Fuser Controller", U.S. application Ser. No. 564,173 and in the name of W. L. Valentine entitled "Chain-Feed Control Logic In A Multi-Mode Copier/-Duplicator" U.S. application Ser. No. 564,172, both applications assigned to the same assignee as the instant invention.

BACKGROUND OF THE PRIOR ART

1. Field of the Invention

The invention is in the field of photocopy machines and copier/duplicator machines which have multiple modes of operation. In particular, the invention pertains to cycle-out logic circuitry for delaying mode changing operations in machines having large document copying modes of operation, as well as base modes of operation.

2. Description of the Prior Art

Multi-mode copier/duplicator machines are known in the prior art and may, for example, utilize fixed and movable optical systems for operation in different modes such as a BASE Mode and a Large Document Copying (LDC) mode, respectively. In the BASE Mode of operation, documents up to 8½ inches × 14 inches may be copied, whereas in the large document copying mode, documents up to 18 inches × 14 inches may be copied. An example of such machines is described in detail in copending application, Ser. No. 369,997, filed June 7, 1973 and Ser. No. 528,163, filed Nov. 29, 1974 (D/73383C). In such machines, the operator may change modes from, for example, a first or BASE Mode to a second or LDC mode of operation by moving a mechanical lever, pressing a button or the like. In such instances, the operator may, in fact, change modes during a copying cycle, and such mode changing has resulted in improper operation of the control logic circuitry. In some cases the control logic would go into some undefined state or result in an erroneous jam indication. In other cases, mode changing in the middle of a machine cycle would lead to the new mode dominating machine operations which results in an inability to detect copy paper jams for the copy in process. In general, mode changes by the operator initiated before the major photographic functions of the copier/duplicator result in undesired operation of the machine inasmuch as the control logic mode change is incompatible with the machine mode in process.

SUMMARY OF THE INVENTION

It is an object of the instant invention to overcome the disadvantages of the prior art by providing a cycle-out control logic circuit for operation of a copier/duplicator having multiple modes of operation.

It is another object of the invention to provide a cycle-out control logic in a copier/duplicator having a large document copying mode of operation and a BASE Mode of operation.

Yet another object of the invention is to provide a cycle-out control logic in a copier/duplicator having a large document copying mode of operation, as well as a chain feeding mode of operation.

Another object of the invention is to provide a cycle-out logic circuit which delays the mode changing logic signals initiated by the operator in changing from one machine mode to another.

Still a further object of the invention is to provide a cycle-out logic circuit which enables a multi-mode copier/duplicator to continue in performing essential machine functions for a copy in process irrespective of a mode change initiated by the operator.

The invention pertains to a cycle-out control logic circuit for use in a multi-mode copier/duplicator. The circuit comprises means for delaying the mode changing logic during a photocopy machine cycle even though the operator may activate mode changing switches or levers. The mode changing logic enables the logical mode change to be made only after the present key photocopy processes are completed thus preventing the multi-mode copier from entering undesirable and undefined running condition. The logic essentially allows the present machine to cycle-out in its present mode of operation before changing to a new mode.

BRIEF DESCRIPTION OF THE DRAWINGS

Other objects and features of the invention will become more readily apparent from the following detailed description when read in conjunction with the accompanying drawings, in which like reference numerals designate like parts throughout the figures thereof, and wherein:

FIGS. 5A–5B are timing diagrams showing the sequence of operations of the copier/duplicator in the chain feed mode of operation utilizing a small cassette;

FIGS. 16A–16D illustrate circuit details and truth tables associated with key logic elements of the instant invention.

DETAILED DESCRIPTION OF THE PREFERRED EMBODIMENT

1. Mechanical Overview of the Multi-Mode Copier/-Duplicator

Figure 1:
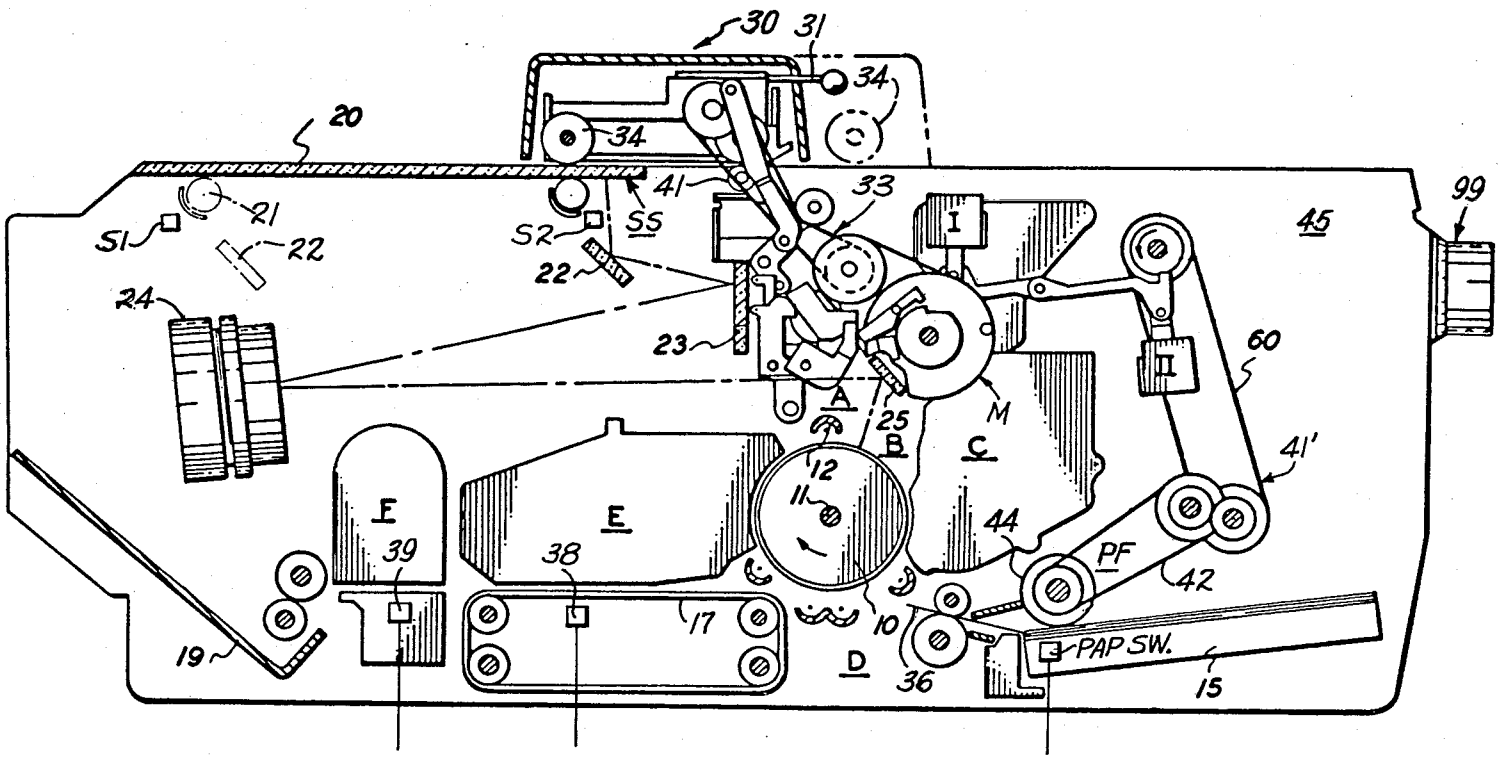
FIG. 1 is a schematic side view of a copier/duplicator in which the chain feeding control logic of the instant invention may be utilized.

The control circuitry of the present invention will be described in the context of a xerographic copier/duplicator machine of a specific design. However, it should be noted from the outset that although the description is in the context of the xerographic machine, the scope of the present invention is not limited to the xerographic machine. Clearly as will be evident from the following description, the principles of the present invention can be applied to other types of machines having similar operational requirements. Now referring to the drawings, as shown in FIG. 1, a xerographic copier/duplicator machine typically includes various elements for implementing xerographic steps. It comprises a drum 10 that may be driven clockwise about an axis 11. The drum includes a photosensitive insulating layer surface 12 around the periphery of which various controlled elements are situated; namely, charging station A, imagewise exposing station B, developing station C, image transfer station D, cleaning station E, and fusing station F, etc., for effecting the usual steps involved in making xerographic copies. The machine may be further provided with a suitable feeding means PF for feeding copy sheets of paper from a paper supply in a cassette 15 and a suitable paper transfer means 17 for transferring the imaged paper onto the fusing station F where the toner image is fused onto the paper and then feed out to a suitable receptacle means 19.

The xerographic copier/duplicator machine may be designed to operate in different modes. In a first, or BASE Mode, conventional documents up to a certain size are copied and in a second, or LDC Mode, larger size documents are processed. For example, in the BASE Mode, the machine is designed to employ a moving optical scanning arrangement 21–24 to scan a stationary original placed on a platen 20 in making copies up to 14 inches in length and 8.5 inches in width. In the LDC Mode, the scanning arrangement is held at a stationary position, and the document original is moved past a scanning station SS. In the LDC Mode, document originals up to 14 inches by 18 inches may be copied.

Figure 2:
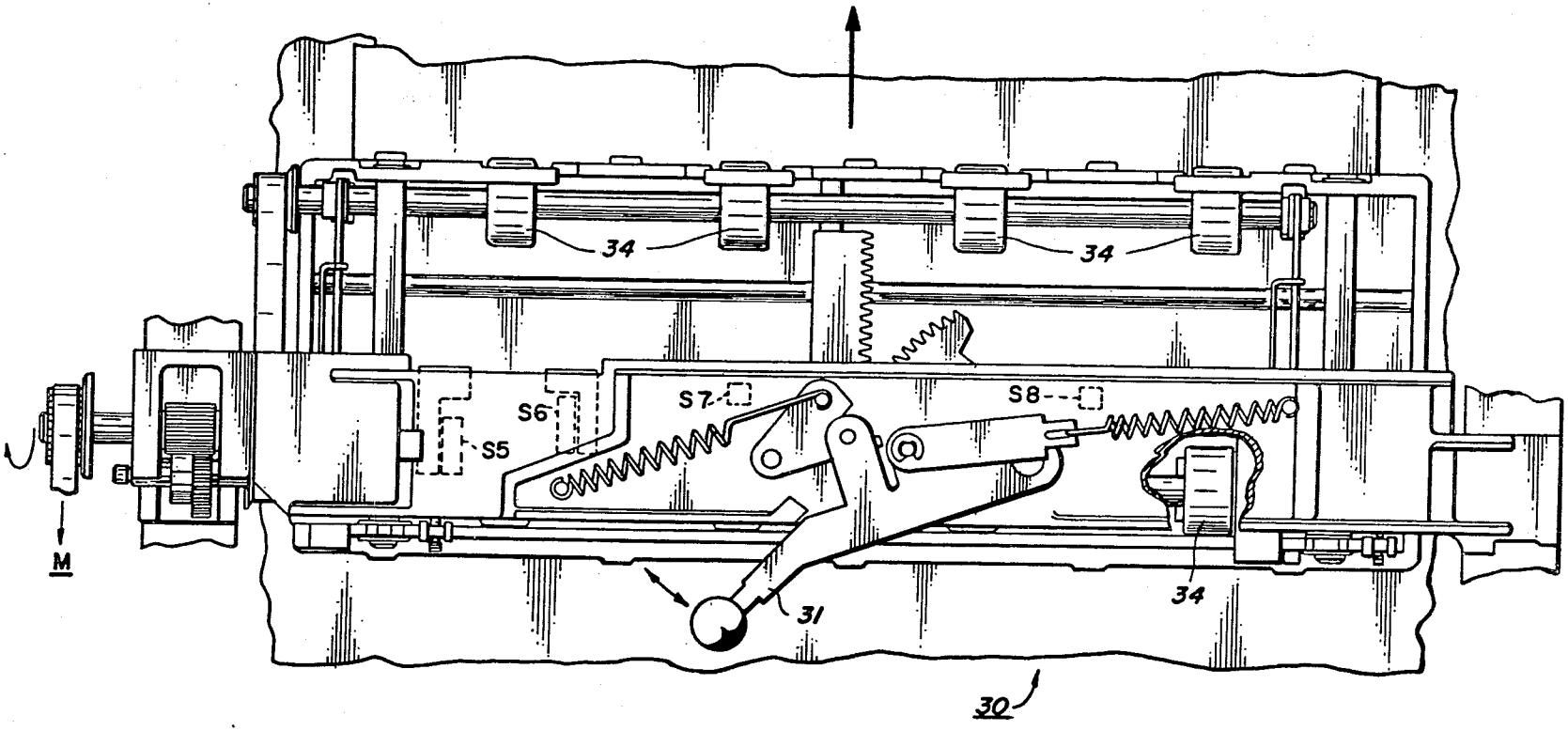
FIG. 2 shows a schematic top view of the document feeding means that may be used as an accessory to the base machine when the machine is operating in the LDC Mode.
Figure 3:
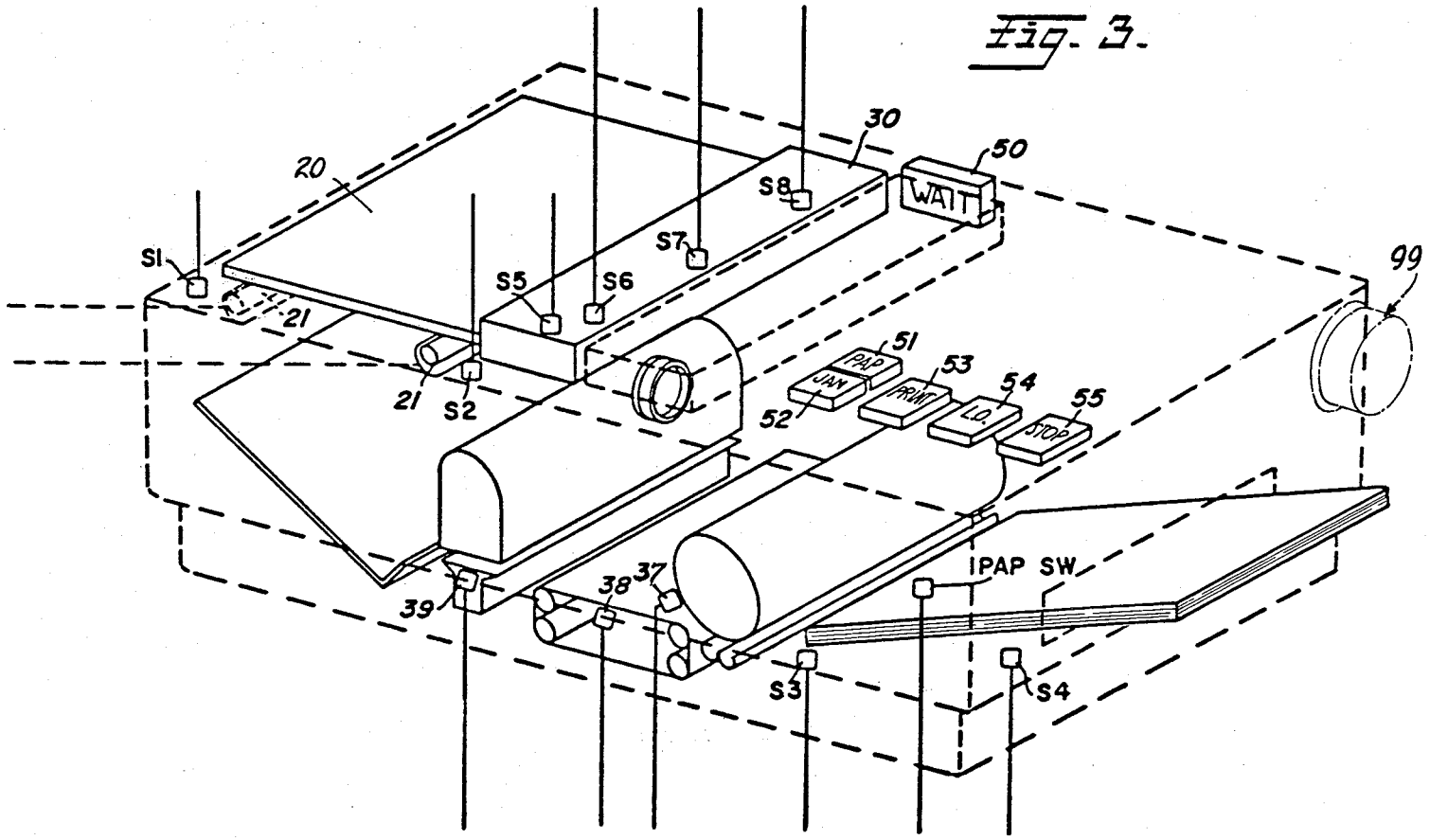
FIG. 3 shows a perspective view of the copier/duplicator of FIG. 1 illustrating the position of control switches and sensing elements.

Referring to FIGS. 1–3, in BASE Mode operation, the scanning arrangement 21 is moved across the width of the platen 20 by a carriage (not shown) so that the associated optical means 22–25 projects the image of the original on the xerographic drum surface 12 at the image exposing station B. In BASE Mode operation, the machine is designed so that, in each copy run after an initial warm-up period, each successive xerographic copying cycle is accomplished in the same given time interval. The cycle time starts as the scanning means leaves the start scan position near the Home Switch S1 and continues to move past the platen and ends as it reaches the end of scan position at the End of Scan Sensing Switch S2. The next cycle begins as the scanning means automatically flies back to the home or start scan position. In BASE Mode, the operator may initiate a multiple copy mode by setting dial 99 to the desired number of copies.

In the LDC Mode of operation, a large document original is fed through a feeding means 30 such as that shown in a pending U.S. application Ser. No. 205,911 filed on Dec. 8, 1971, or in the U.S. Pat. No. 3,731,915 issued to Guenther. For example, as shown in the aforementioned copending application Ser. No. 284,687, the document feeding means 30 may be stationed outside of the platen 20 and be in a disengaged position when the machine is to operate in the BASE Mode as shown in dotted lines of FIG. 1. It includes a lever 31 which is designed so that by moving it clockwise the feeding means 30 is brought into or engaged into a position as shown in solid lines so that it can operate in the LDC Mode. In this position, the document original can be fed past the scanning station SS. A suitable mechanism 33 is provided in the machine for coupling feed rollers 34 to the main drive M when the document feeding means 30 is moved to the LDC position. Once engaged, the rollers 34 driven by the main drive M feeds the document original to the left past the scanning station SS. The speed with which the paper is fed past the scanning SS is synchronized with the speed with which the copy paper 36 from the paper cassette 15 is fed into a transfer relationship with the photosensitive insulating layer 12 by a suitable paper feeding means PF. When it is desired to operate the machine in the BASE Mode, the document feeding means is simply moved out of the way of the platen by rotating the lever 31 counter-clockwise rotation. The counter-clockwise rotation of the lever 31 moves the document feeding means 30 to the right as shown in dotted lines and out of the path of the scanning station SS. At the same time, the driving mechanism 33 disengages the feed rollers 34 from the main drive M to render the document feeding means inoperative. While in the illustrative embodiment, it is shown that the document original feeding means is moved from one position to another to engage or disengage the machine in the LDC Mode, it need not be so limited. For example, the document feeding means could be held at a fixed stationary position using suitable actuating means such as a push button to engage or disengage document feed rollers and thus selectively engage the feeding means for the LDC Mode.

In the BASE Mode, a control circuitry of a conventional design may be used to provide signals necessary for the selective enabling of certain elements such as charging, exposing, developing, image transferring, fusing and cleaning means that implement the steps necessary in making a copy. The circuitry may be of electro-mechanical or electronic components such as that shown in the U.S. Pat. No. 3,301,126 issued to R. F. Osborne et al. on Jan. 31, 1967, or that shown in the pending application Ser. No. 348,828 filed on Apr. 6, 1973, now U.S. Pat. No. 3,813,157, which acts to implement various xerographic process steps at appropriately timed intervals at various points in the processing operation under conditions where necessary timing is desired from a clock or cam mechanism or other suitable means. Generally, as described in the above mentioned copending application Ser. No. 367,996 for BASE Mode, the timing of the xerographic copying cycle is keyed to the scanning operation of the scanning means. Thus, in the BASE Mode, each cycle of xerographic processing steps during the making of successive copies in a copy run is keyed to the start and end of the scanning operation involving the movement of the scanner carriage between the home position (at Switch S1 in FIG. 1 or 2) and the end of scan position (at Switch S2 in FIG. 1 or 2).

In addition, the control circuitry is also provided with a suitable design such as that shown in the U.S. Pat. No. 3,588,472 issued to Thomas H. Glaster et al. on June 28, 1971 or in the U.S. patent application Ser. No. 344,322 filed on Mar. 23, 1973, now U.S. Pat. No. 3,832,065, for detecting various malfunctions of the machine. For example, referring to FIGS. 1 and 2, the machine may include a detack detecting means 37 for detecting the failure of copy paper separation from the drum surface 12, a jam detection means 38 for detecting a paper jam that may occur along the paper path, and heat sensing element 39 for monitoring the temperature of the fusing station F. The output of these detecting means form a part of the input signals to the control circuitry of the present system.

In the present machine, various sensing elements in the form of switches are used to provide certain necessary input signals to the control circuitry. These switches are shown schematically in FIGS. 1–3; Table 1 contains a brief functional description of each.

TABLE 1

Figures 4, 6, 7, 8, 9, 10, 11, 12, 13, 14, 15:
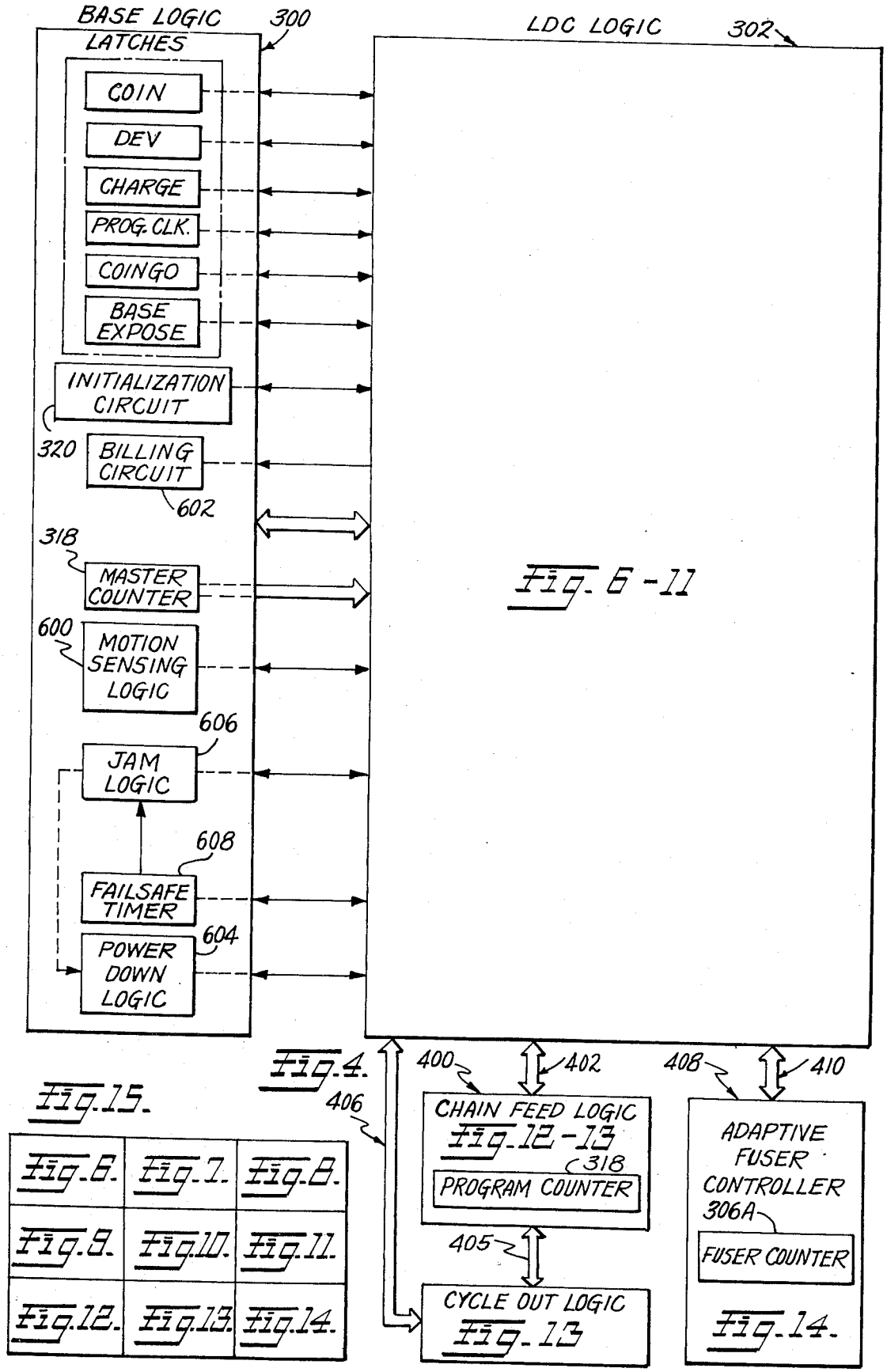
FIG. 4 is a block diagram of the cycle-out control logic showing its interconnection to the multi-mode copier/duplicator.
FIGS. 6–14 show the detailed logic diagram of the cycle-out control logic of the instant invention and its interconnection to the copier/duplicator.
FIG. 15 illustrates the arrangement of FIGS. 6–14 to form the detailed logic diagram.

| FUNCTIONAL DESCRIPTION OF INPUT SWITCHES (See FIGS. 1–3 for switch locations; FIGS. 6 and 9 for switch interconnections) | |
|---|---|
| HOME SWITCH | The Home Switch S1 is used for indicating that the optics scanning carriage is at the home or start position of the scan cycle. It is actuated when the optics scanning carriage is at the home position and provides two complementary outputs to the control logic circuitry. The outputs denote (in positive true logic terms) the "At Home" and "Off Home" condition of the optics scanning carriage. |
| END OF SCAN SWITCH: | The End of Scan Switch S2 is used to sense the presence of the optics scanning assembly at the end of scan position. It is normally deactuated and is actuated when the scanning assembly reaches the desired position. Upon actuation it provides a logical "O" level to the control logic. |
| TRAILING EDGE SWITCH: | The Trailing Edge Switch S3 is utilized to detect the trailing edge of a sheet of copy paper as it leaves feed rollers adjacent the paper cassette. It is normally deactuated and exhibits an open circuit. In the presence of copy paper it is actuated providing a logical "O"; on passage of the trailing edge it again opens removing the logical "O" from the control logic. |
| LARGE CASSETTE SWITCH | The Large Cassette Switch S4 is utilized to sense the presence of the large paper cassette in the paper tray. It is normally deactuated; it actuates in the presence of the large paper cassette thereupon providing a logical "1" to the control logic. |
| MODE CHANGE SWITCH: | The Mode Change Switch S5 senses the movement of the document feeding means 30 into the LDC Mode position. It is normally in the open state. It closes momentarily as the document feeding means 30 moves into position for the LDC Mode of operation and starts the process of initializing the control logic circuitry. S5 is a one-way roll-over type switch that actuates in one way when the machine goes from the BASE Mode to the LDC Mode but not vice versa. It serves the function of the Print Button in initializing logic components in going from BASE Mode to LDC Mode. |
| LDC MODE SWITCH: | The LDC Mode Switch S6 is actuated as the document feeding means 30 moves to the LDC Mode position from BASE Mode position. It is normally open. On actuation, it provides a logical "O" to the control logic circuitry. The logical "O" from this switch indicates a mode change of the machine from the BASE Mode to the LDC Mode; and further, of the continued operation of the machine in the LDC Mode. |
| DOCUMENT SWITCHES: | The Document Switches S7 and S8 are utilized to sense the document original being fed into the copier. The switches are normally closed, are connected in series, and provide a logical "O" to the control logic. One or both switches open in the presence of the document original to signify its presence. When thus opened, the logical "O" is removed from the control logic. Operation of either one or both is utilized to signify the presence of the document original as well as the |

TABLE 1 -continued

| FUNCTIONAL DESCRIPTION OF INPUT SWITCHES |
|---|
| (See FIGS. 1–3 for switch locations; FIGS. 6 and 9 for switch interconnections) |
| leading and trailing edges of the document original |

Briefly stated, the switches S1–S8 above are connected to operate and provide the following functions. The Home Switch S1 when actuated shows that the scan carriage is at the home position. The End of Scan Switch S2 is in a non-actuated condition at this point. Now suppose the operator wishes to operate the machine in an LDC Mode. The lever arm 31 is moved clockwise to place the document feeding means 30 to the left and thereby place the machine in the large document copying mode. As the lever arm 31 is rotated, the LDC Mode Switch S6 is actuated and then the switch S5 is momentarily actuated. This initializes the control circuitry for the LDC Mode of operation.

In response to such initializing, the control circuitry causes the scanning arrangement and associated optics to move into the LDC position, that is, to the end of the scan position associated with switch S2. Furthermore, the control logic associated with LDC Mode of operation is so designed that the action of copy paper feed solenoid II in selectively feeding copy paper is prevented or inhibited while the scanning elements 21 and 22 move to the end of the scan position. When the scanning elements reach the end of the scan position, this is sensed by the End of Scan Switch S2. In turn, the Switch S2 provides the End of Scan Signal. In response, the scanning and optic elements are retained in that position by a suitable pawl and ratched mechanism. For a detailed discussion of an exemplary mechanism of this type, one may refer to the above mentioned copending application Ser. No. 367,996. This prevents the scan carriage means from automatically returning to the home switch position as is done in BASE Mode operations, and when the scanning means reaches the end of scan position, the main drive M drives the document original feed rollers 34.

In response to the end of the scan signal, the control circuitry removes the constraints on the operation of the solenoid II to allow the copy paper feeding means PF to selectively operate. With the solenoid enabled, the drive belt means 41 and 42 are prevented from engaging with the main drive M and no copy paper is fed. When Solenoid II is de-actuated by the control logic in response to an actuation of the Document Switches S7 and S8, as the document original passes thereby, the drive means engage and the main drive M is allowed to drive the copy paper feed rollers 44 in synchronism with the speed with which the document original is fed past the scanning station SS. The switches S7 and S8 actuate as the document original paper is fed therepast in the paper feeding means 30, and enables the control logic to proceed with LDC Mode of copying operation. Absent any malfunction, the machine proceeds to complete the copying operation.

There are a number of indicating means that may be provided in the copier/duplicator machine, as shown in FIG. 2, to provide the following functions:

-continued

| | |
|---|---|
| WAIT | This is a visual indication means 50. It is connected in a manner to provide the "Wait" indicia when document feeding means 30 is moved to the LDC position, and this condition is maintained by the control circuitry until the scanning element 21 moves to the end of the scan position and the machine is ready to make copies. The lighted indicating means 50 comes to the view of the operator during this time and alerts the operator to wait until the indication terminates before the document original sheet is fed through the feeding means 30. The indicating means 50 may include a suitable notation "WAIT" for the operator's convenience. Preferably, the light indicating means 50 may be positioned above the console of the base machine as shown in FIG. 2 at a position where it will be hidden behind the housing of the paper feeding means 30 when the same is positioned for BASE Mode operation. The Wait light comes on from the time of charging until exposure is turned off. |
| ADD PAPER | An indicating means 51 "ADD PAPER" is provided to apprise an operator that attention to the paper supply is necessary. It may be so connected that it is energized by the control circuitry when the paper supply runs out or when the incorrect size paper supply is present. |
| JAM OR CLEAR PAPER PATH | This indicating means 52 is provided to signify to the operator the paper jam condition is present and requires clearing. |

In addition, certain controls are provided in the machine for inputting particular command signals to the control circuitry. For example:

| | |
|---|---|
| PRINT | This input, button 53, is used to enable the operator to start the machine in the BASE Mode or in the alternative in the LDC Mode if the machine is already held in the LDC Mode. The Print button serves to actuate the Initialization Circuit to supply power to logic elements. |
| LIGHT ORIGINAL | This input, button 54, serves the function of starting the appropriate machine cycle when the original is light and it is desired to provide a darker copy. If the machine is in the BASE Mode, it may be placed in the LDC Mode by moving the lever arm clockwise and movement of the lever is accomplished by the operation of the momentary switch S5 and the LDC Mode Switch S6 to provide the print command signal. However, if the machine is already in the LDC Mode, then a depressing of either the PRINT button 53 or LIGHT ORIGINAL button 54 provides the print command signal. |
| COPY QUANTITY DIAL | This input, dial 99, is used to enable the operator to select the number of copies desired of a single original document. It is operative only in the BASE Mode of operation. |
| STOP | The STOP input, button 55, is used for stopping the machine in the middle of its operation and causes the control circuitry to stop the machine at the end of the copying cycle in process. |

The features tabulated above are common to many copier/duplicators well known in the art and their use in multi-mode copier/duplicators is more fully set forth in the above mentioned copending application of L. R. Sohm entitled "Dual Mode Control Logic For A Multi-Mode Copier/Duplicator" (D/73383C).

2. Block Diagram Description

FIG. 4 is a block diagram of the overall electronics associated with the multi-mode copier/duplicator having the cycle-out logic circuitry of the instant invention. The copier/duplicator comprises a BASE LOGIC circuit 300 which comprises a plurality of latches (coincidence latch, development latch, etc) which form part of the copier/duplicator in its BASE Mode of operation. These latches control the basic xerographic processes which are well-known in the art. A plurality of other conventional circuits are shown in the BASE LOGIC 300 and are explained more fully below in connection with the Chain Feed Logic of the instant invention. The copier/duplicator also comprises a LDC LOGIC circuit which modifies the BASE LOGIC circuitry to enable the copier/duplicator to photocopy large documents (14 inchs × 18 inches). A detailed description of the interconnection of the LDC LOGIC 302 with the BASE LOGIC 300 is set forth in copending application, Ser. No. 528,163, filed Nov. 29, 1974 (D/73383C) mentioned above. The instant invention pertains to a Cycle-Out Logic 404 which is shown interconnected to the LDC LOGIC 302 by a plurality of lines 406. In addition, a Chain Feed Logic 400 is connected to the Cycle-Out Logic circuit 404 via lines 402, and the Chain Feed Logic is connected to the LDC Logic 302 by a plurality of lines 402. Finally, an Adaptive Fuser Controller 408 is connected to the LDC LOGIC 302 by a plurality of lines 410. Both the Chain Feed Logic 400 and the Adaptive Fuser Controller 408 form the subject of concurrently filed applications, namely, "Cycle-Out Logic in a Multi-Mode Copier/Duplicator" in the name of W. L. Valentine and "Adaptive Fuser Controller" in the name of Thomas J. Mooney, both applications assigned to the same assignee as the instant invention.

The following description emphasizes the features of the LDC LOGIC in 302 as well as the BASE LOGIC 300 which are particularly germane to the understanding of the Cycle-Out Logic 404 of the instant invention.

3. Timing Diagram Description

As may be seen by reference to FIGS. 5A–5E, the multi-mode copier/duplicator operation is divided into a plurality of time sequences in which different xerographic functions take place and different portions of the copy cycle are executed. The logic circuits utilized to control the xerographic functions are clock controlled and thus may be described in terms of the counter states of a Master Counter 318, Program Counter 316, and Fuser Counter 306A utilized to control machine parameters.

Figure 5:
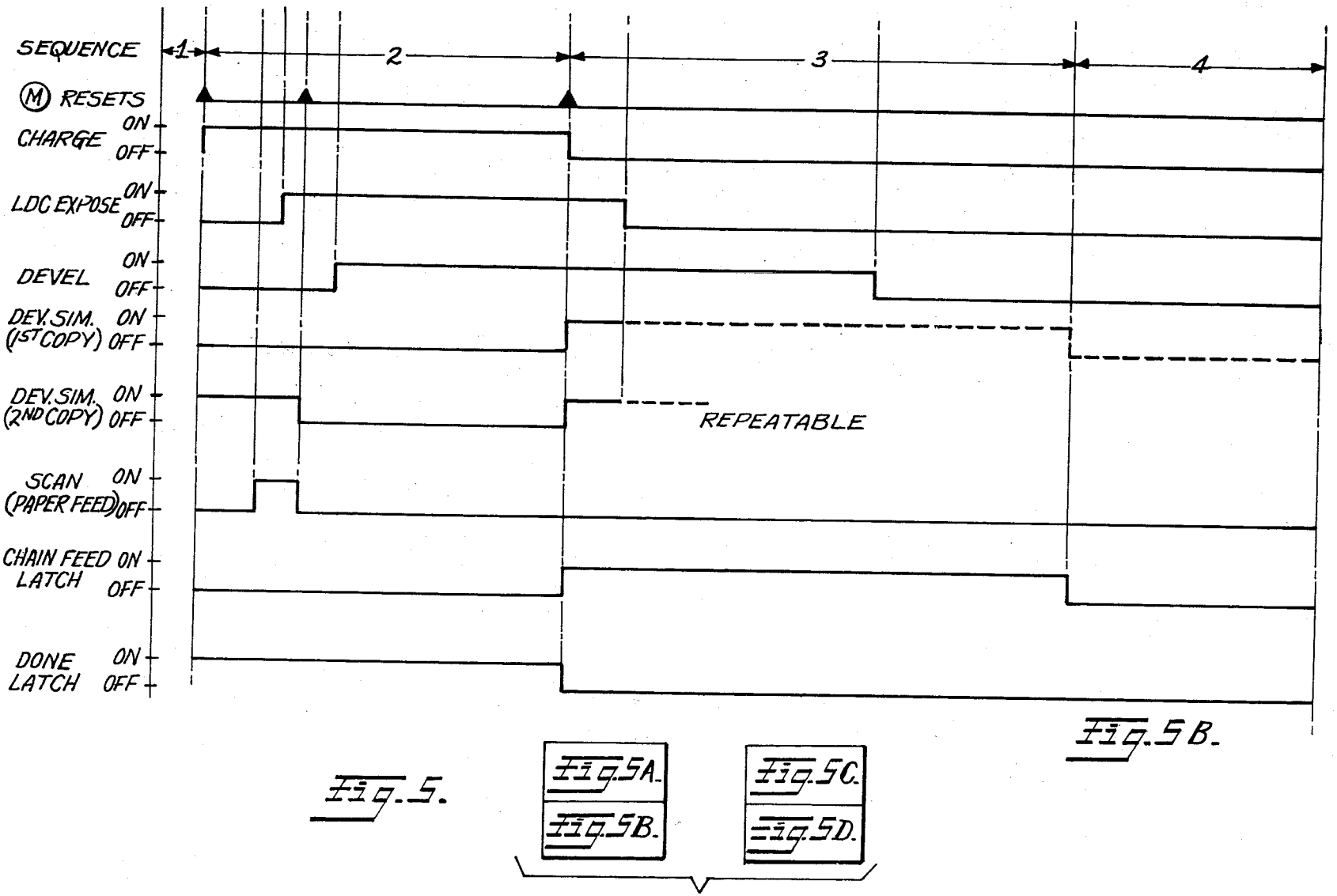
FIG. 5 illustrates the arrangement of FIGS. 5A–5E to form the timing diagram.
Figure 5A:
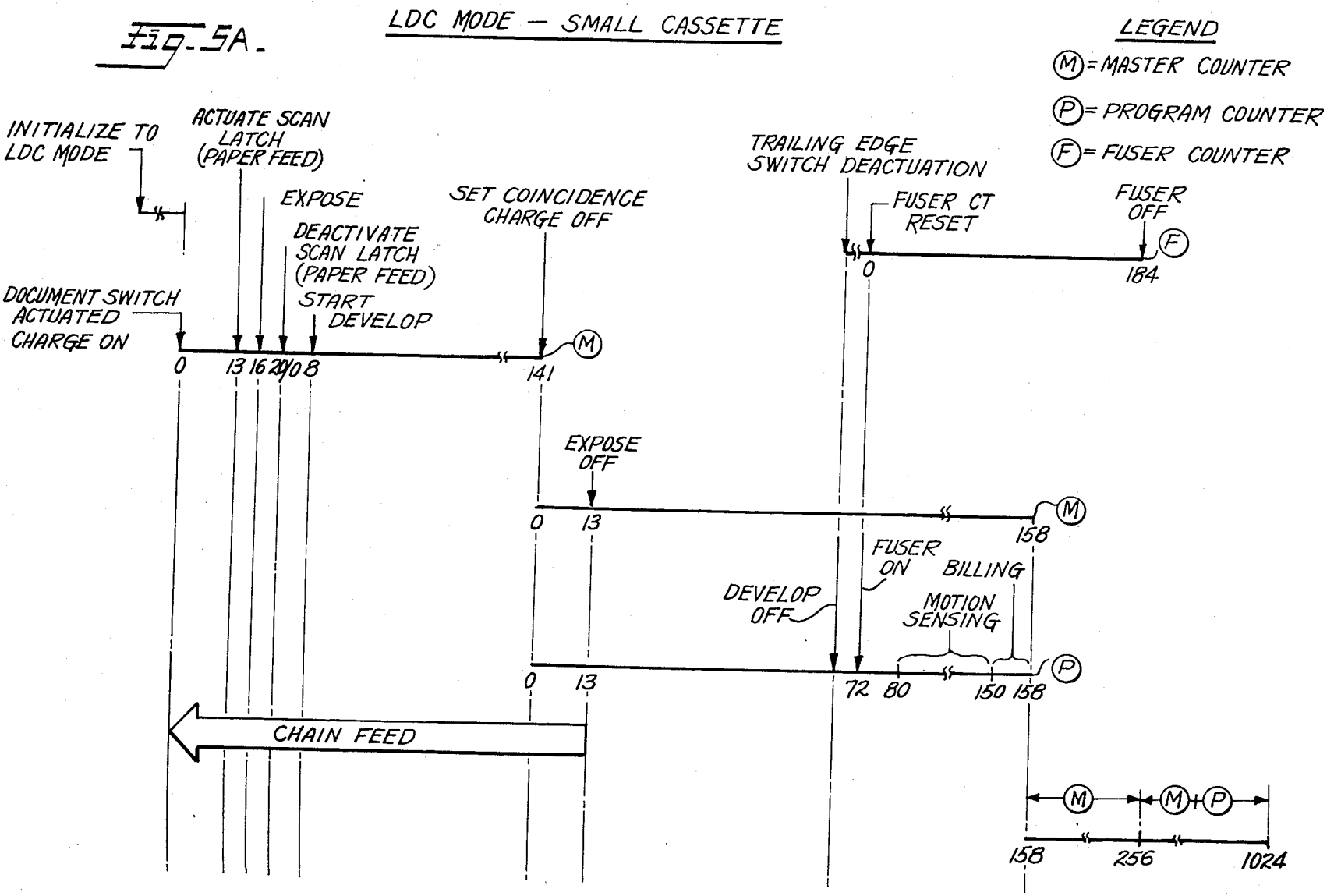
Figure 5C:
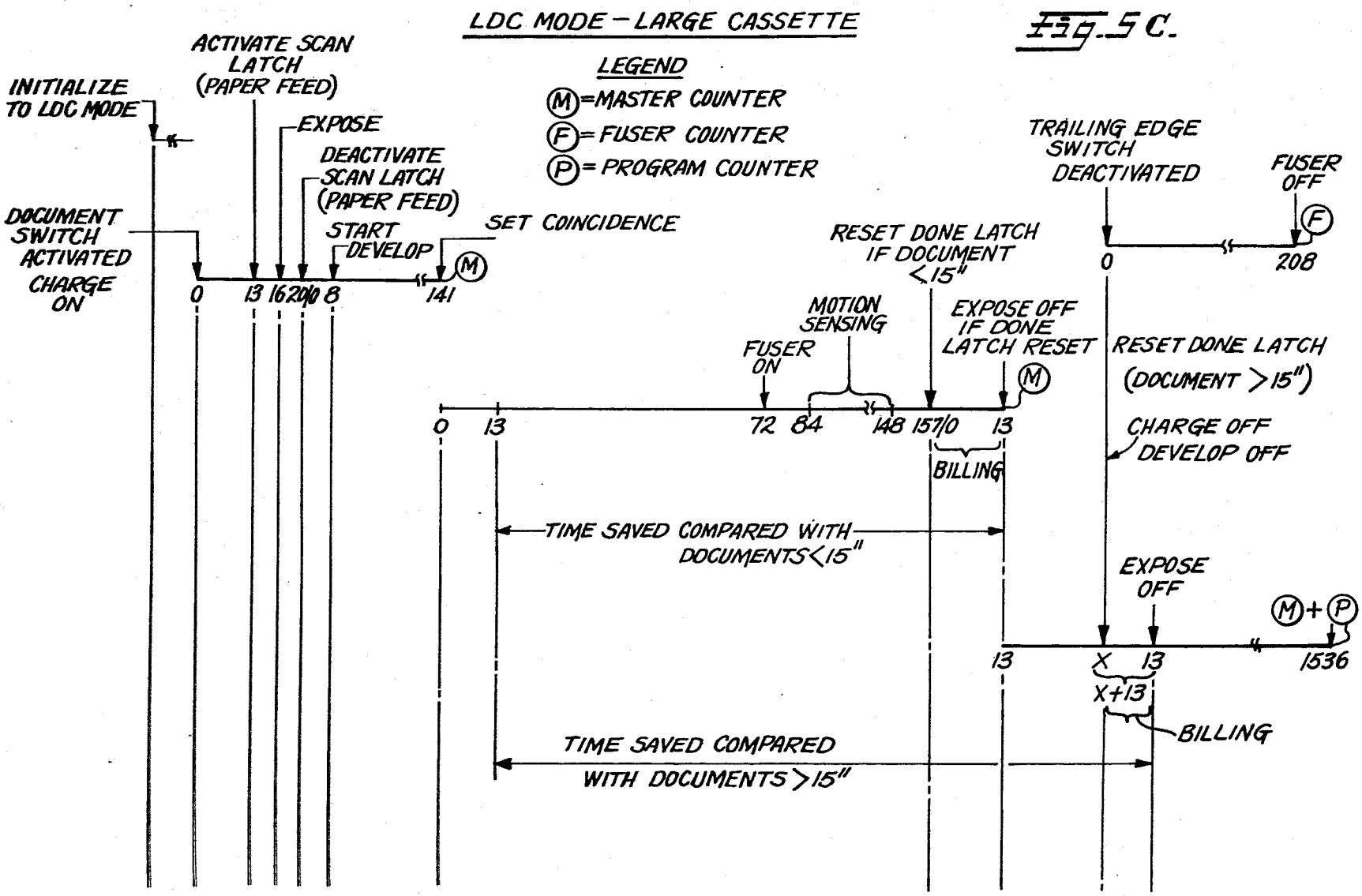
FIGS. 5C–5D are timing diagrams showing the sequence of operations of the copier/duplicator utilizing a large cassette.

As an example to illustrate the counter state description used herein, consider the designation $\overline{\text{CT72M}}$-SQ3 (FIG. 5C). This designation indicates that the Master Counter (M = Master Counter, P = Program Counter, F = Fuser Counter) has accumulated 72 clock pulses, and the designation refers to the counter signals which are decoded in the conventional manner by sampling the pertinent stages of the Master Counter. Also in the usual notation, "bar" is used to denote the logical inverse of the counter state; i.e., this particular signal will exhibit a low logic level (logical 0) on the accumulation of the 72nd clock pulse, when suitably decoded. The designation SQ3 denotes the third sequence in a particular operating mode. Note for example that FIGS. 5A and 5C show the LDC Mode of operation consisting of four distinct sequences. When a particular sequence is further conditioned by size of the copy paper cassette, the appropriate designation is appended to so indicate by the addition of /SC or /LC denoting Small Cassette or Large Cassette Modes respectively.

It is noted that the Large Document Copying Mode enables the document feeding means 30 to convey subsequently fed documents into the copier/duplicator. In this sense, both the LDC/LC (Large Document Copying/Large cassette) Mode as well as the LDC/SC (Large Document Copying/Small Cassette) Mode may be thought of as chain feeding modes of operation. In another sense, inasmuch as a second separate counter (the Program Counter) is utilized to run in parallel with the Master Counter, only in the LDC/SC Mode of operation, the main time saving advantages of the chain feeding copier/duplicator are most noticeable when utilizing the machine in the LDC/SC Mode. Thus, the LDC/SC Mode is often referred to as the chain feeding mode of operation.

Figure 5D:
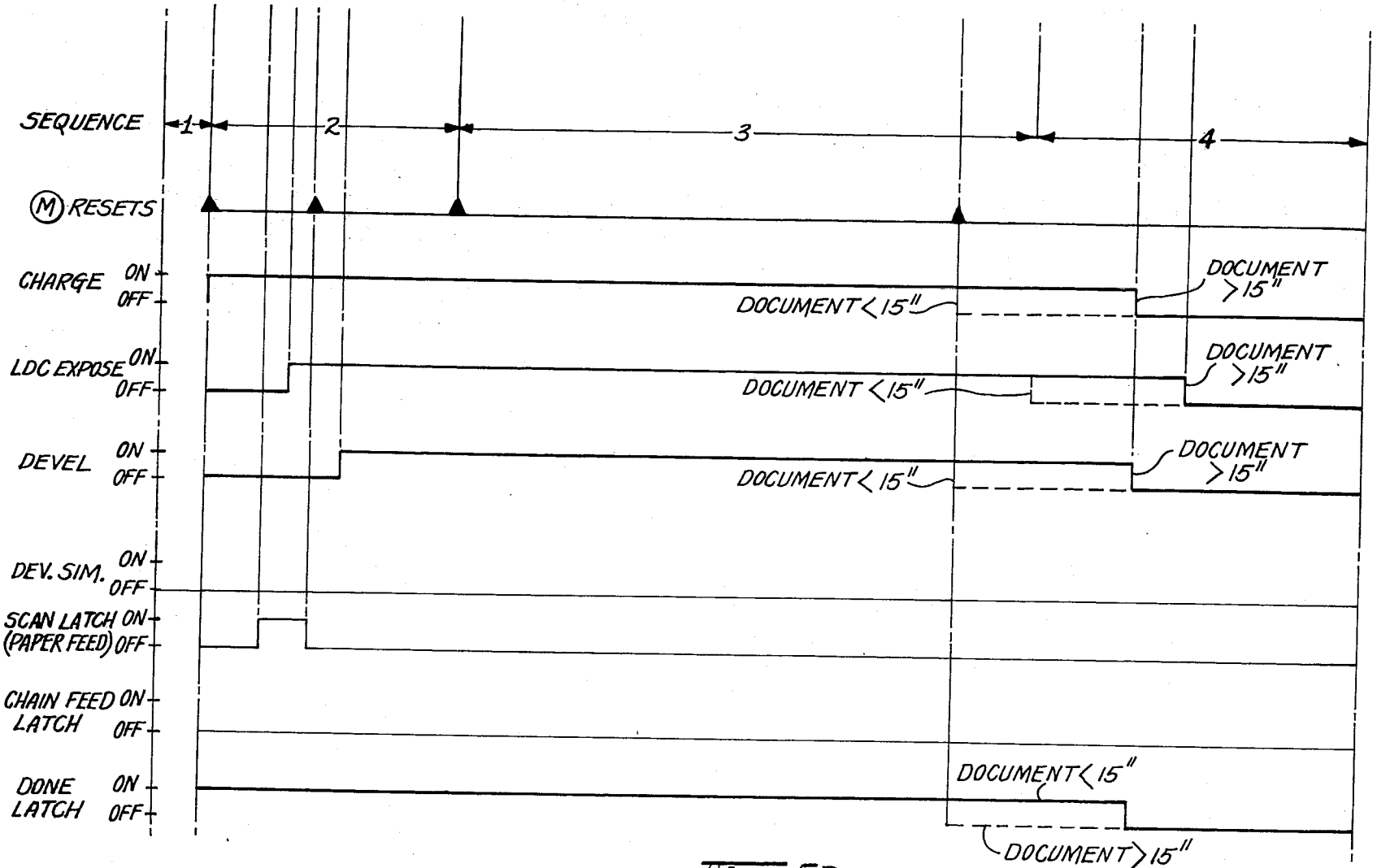
Figure 5E:
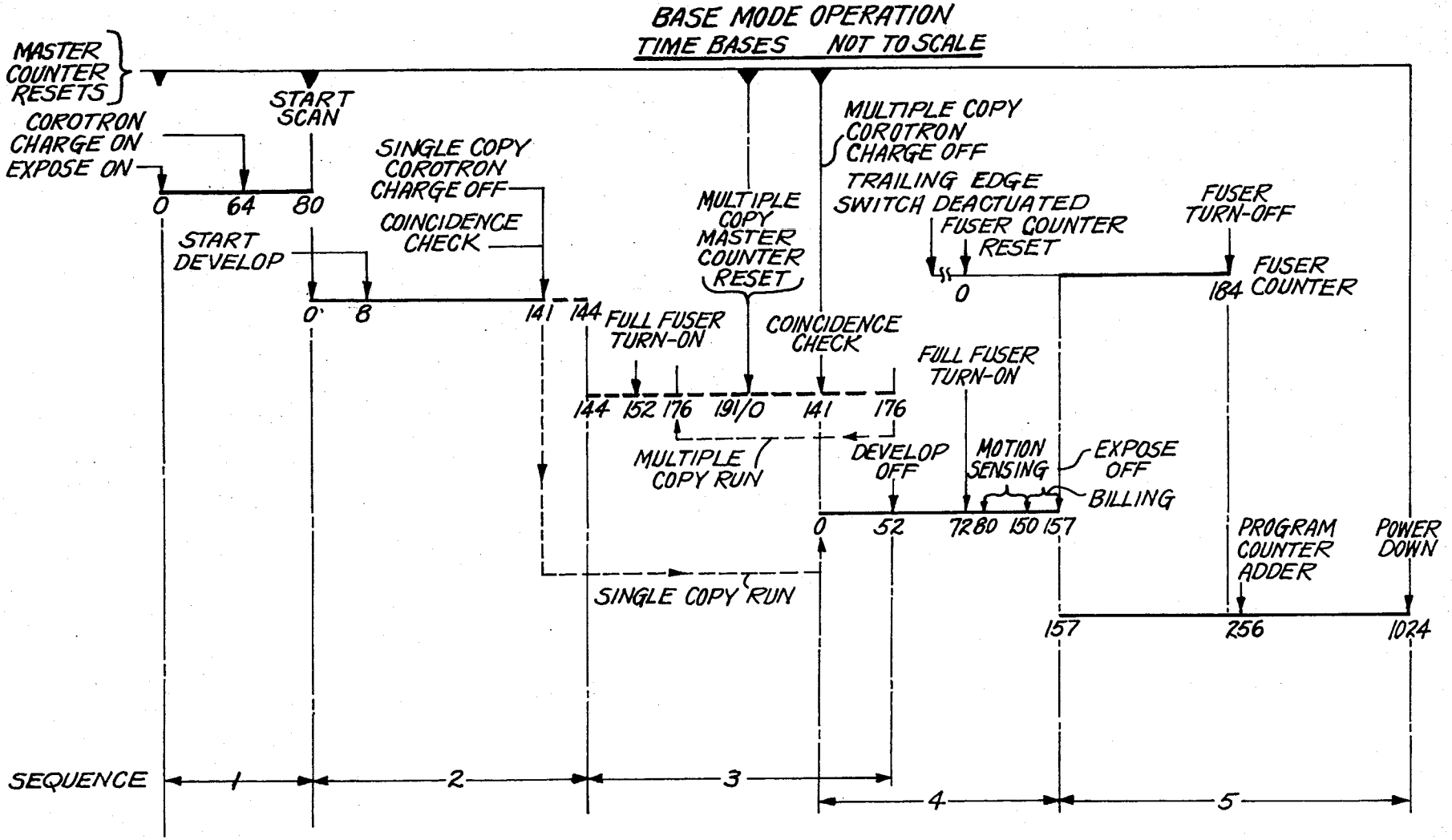
FIG. 5E is a timing diagram showing the sequence of operation of the copier/duplicator utilizing a small cassette in the BASE Mode of operation.
Figure 6:
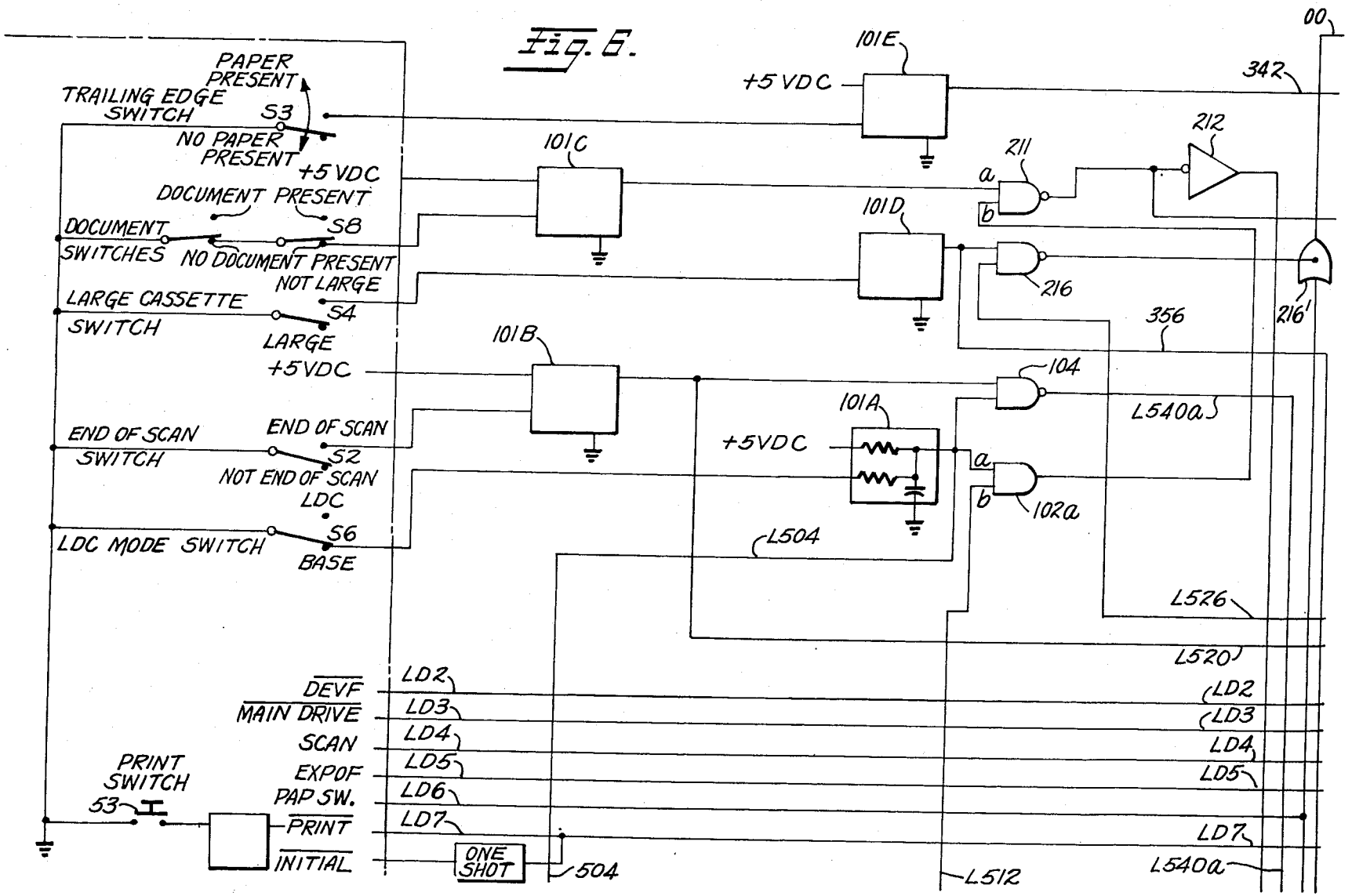
Figure 7:
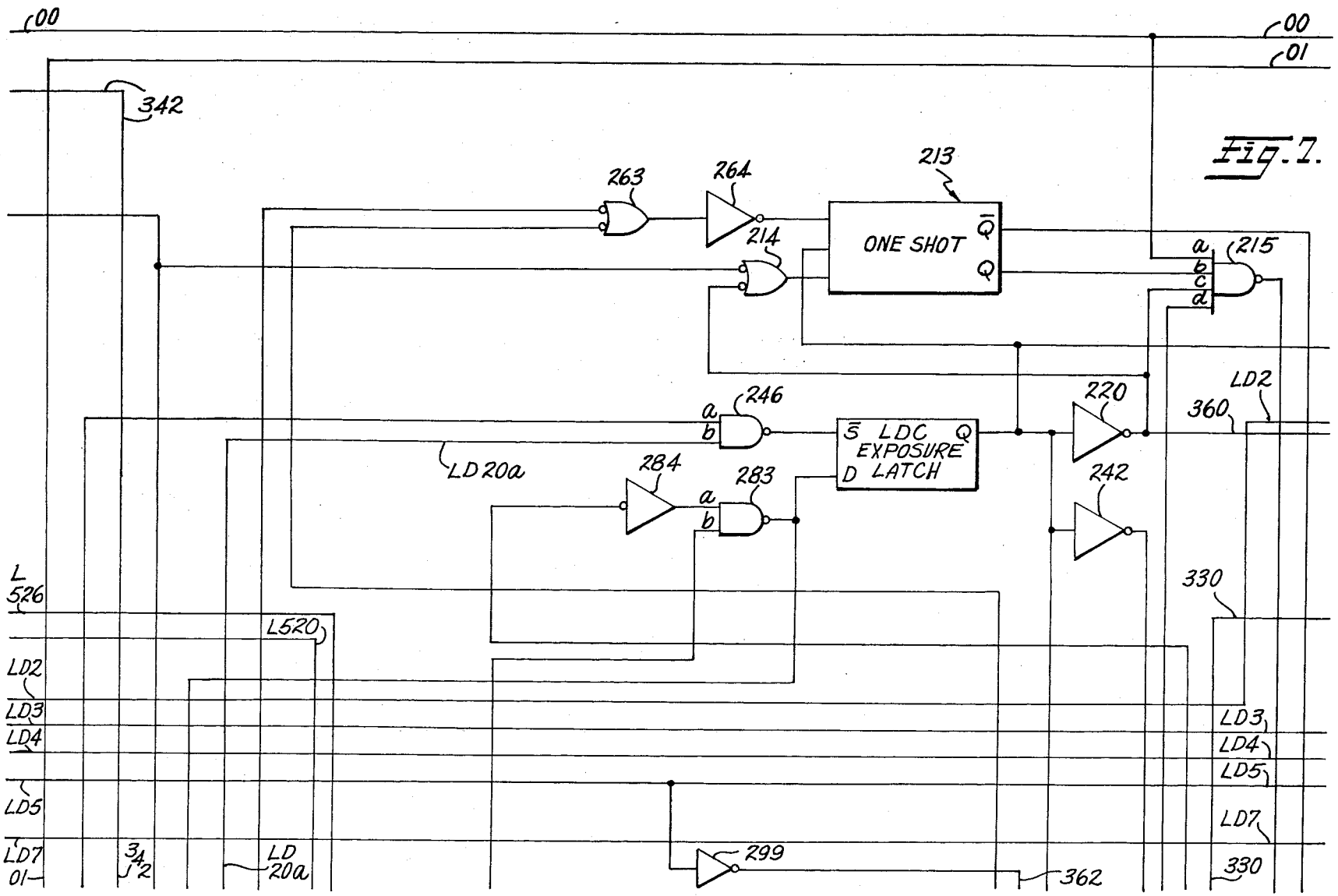
Figure 8:
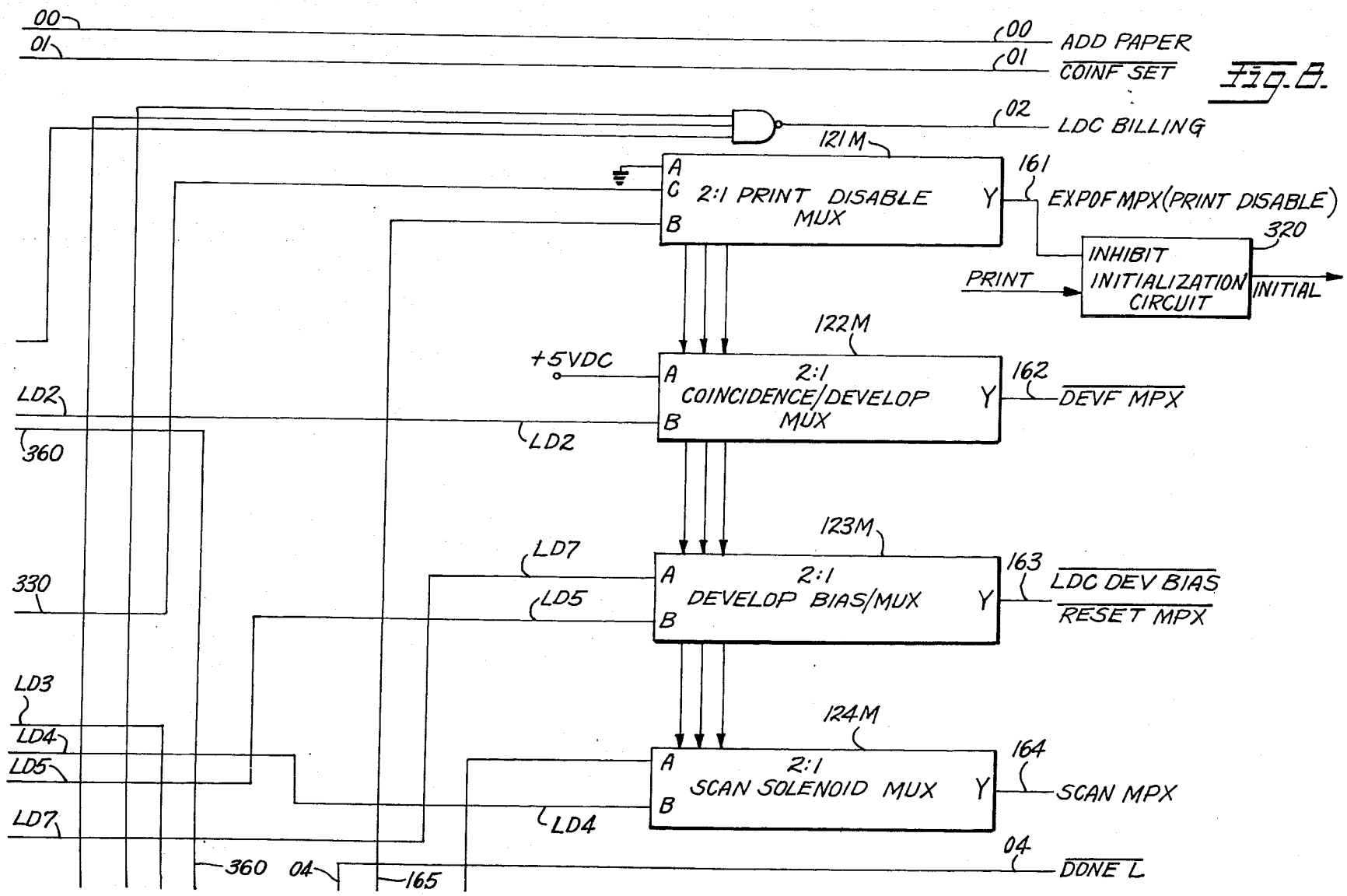
Figure 9:
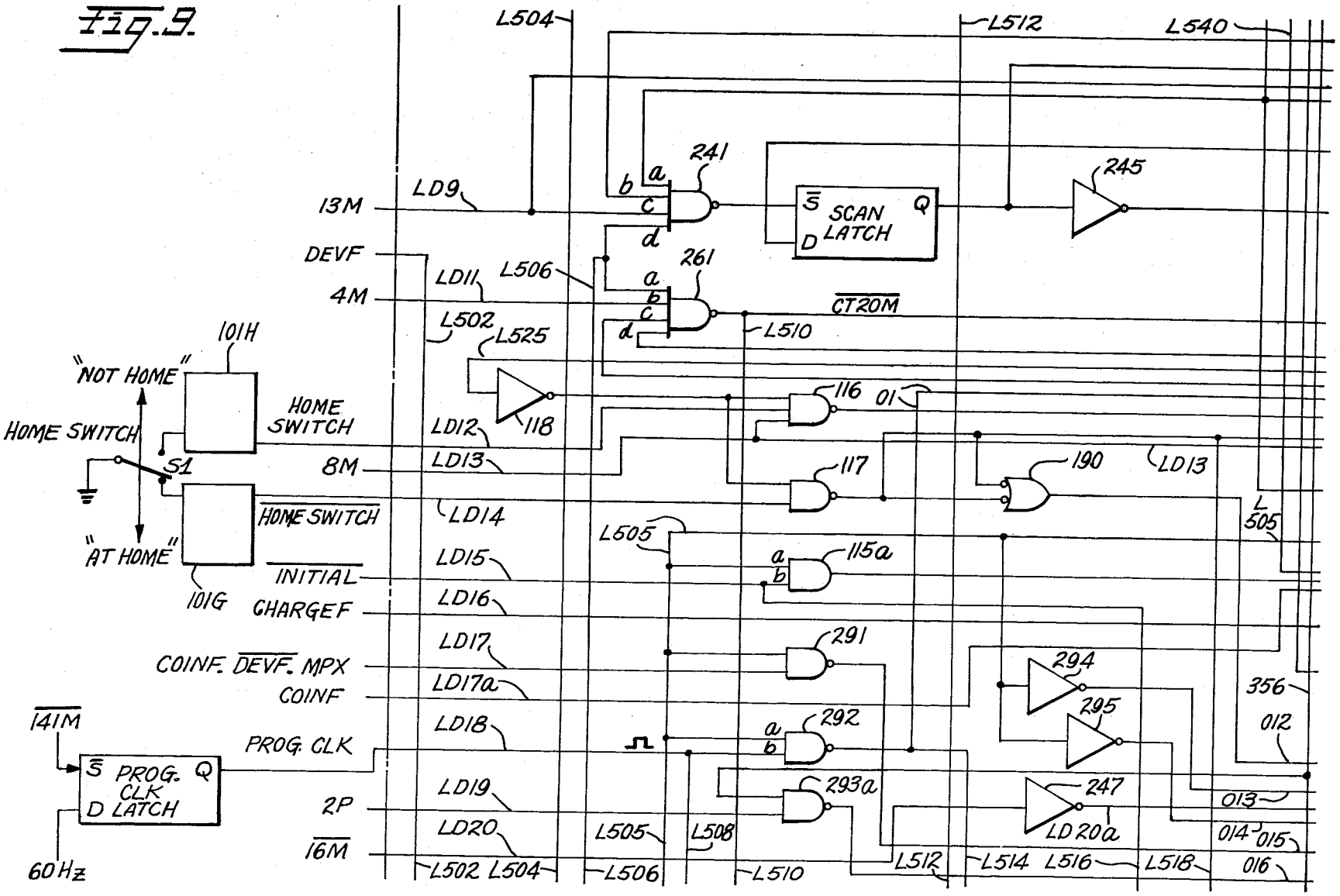
Figure 10:
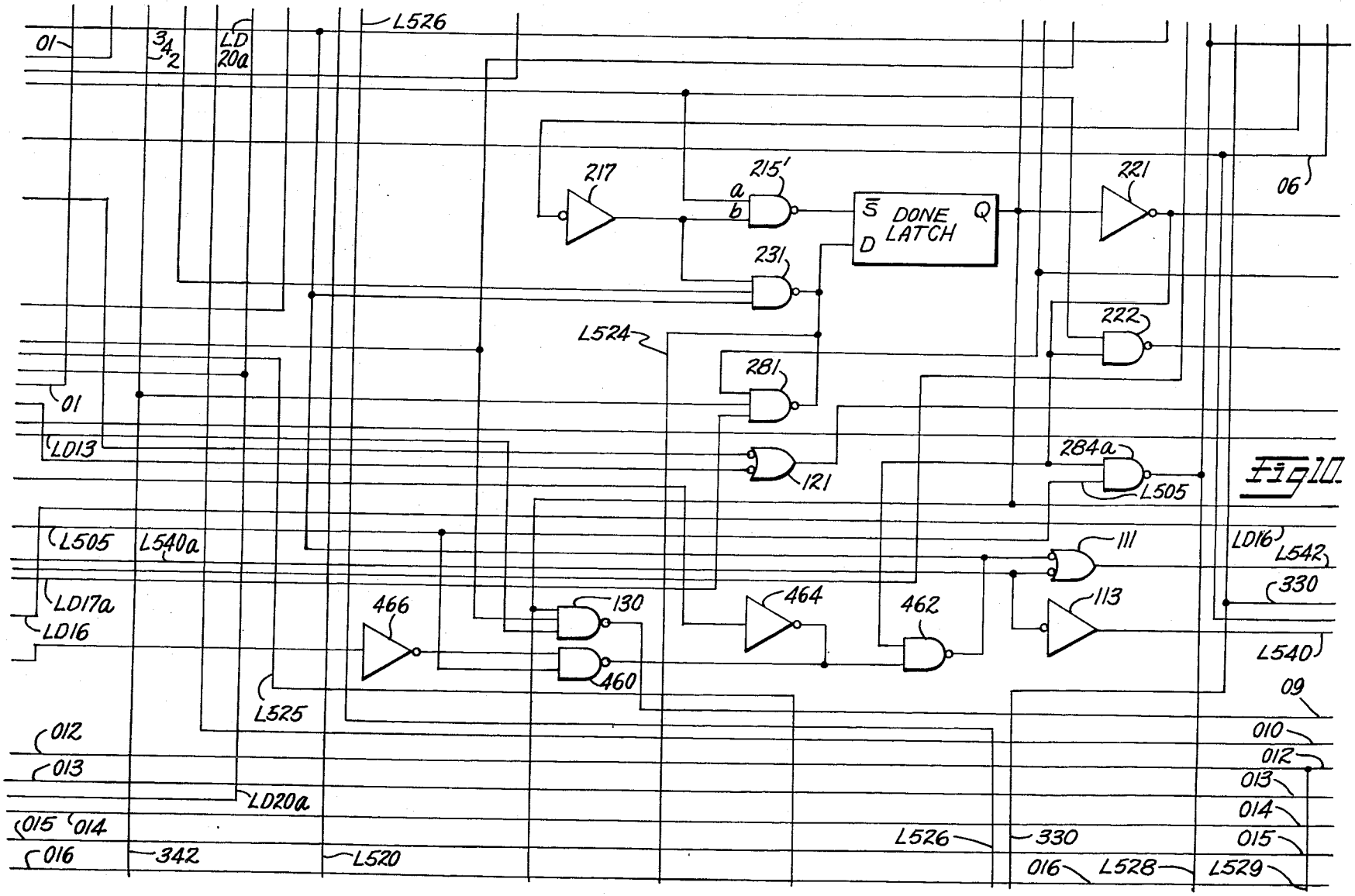
Figure 11:
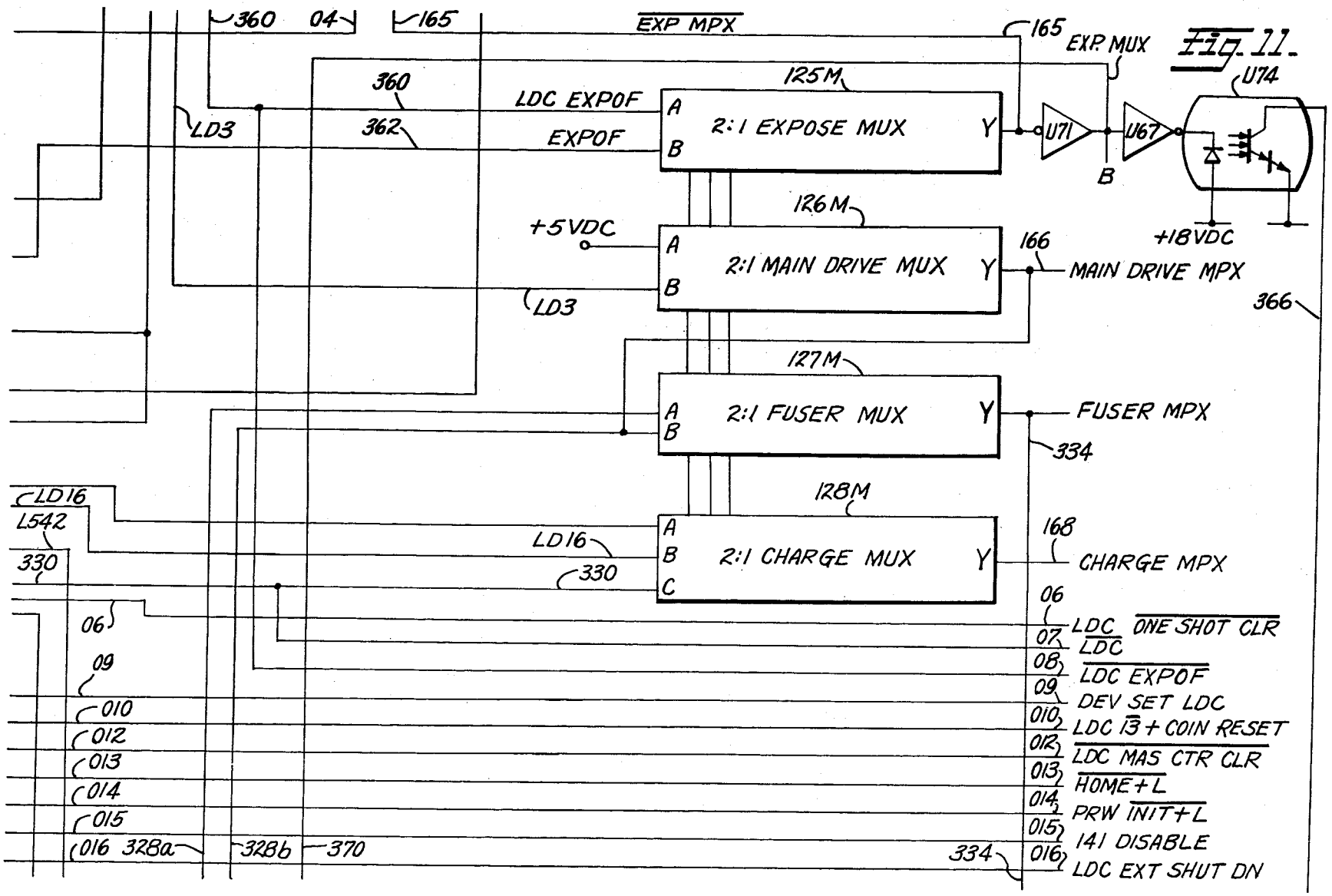
Figure 12:
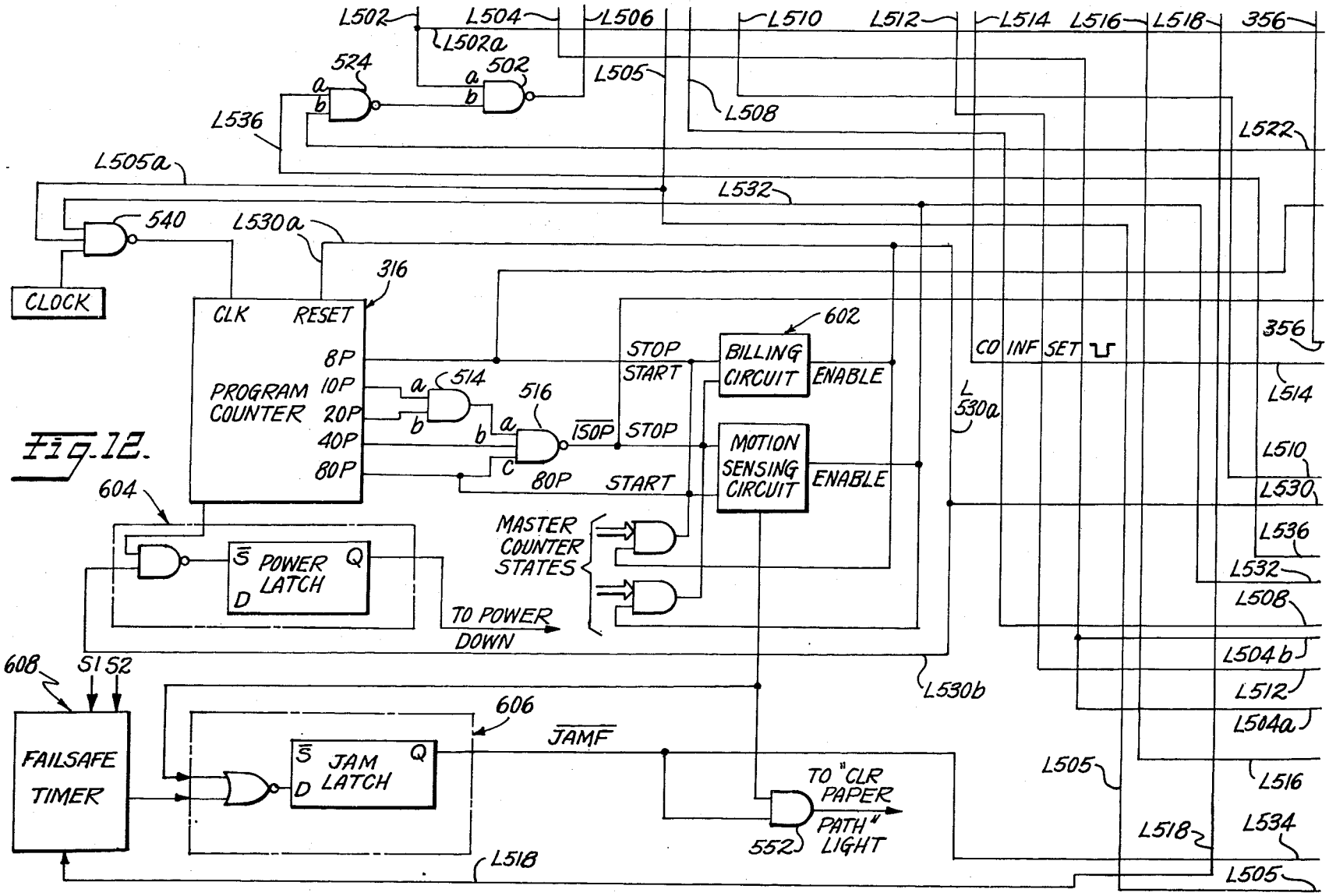
Figure 13:
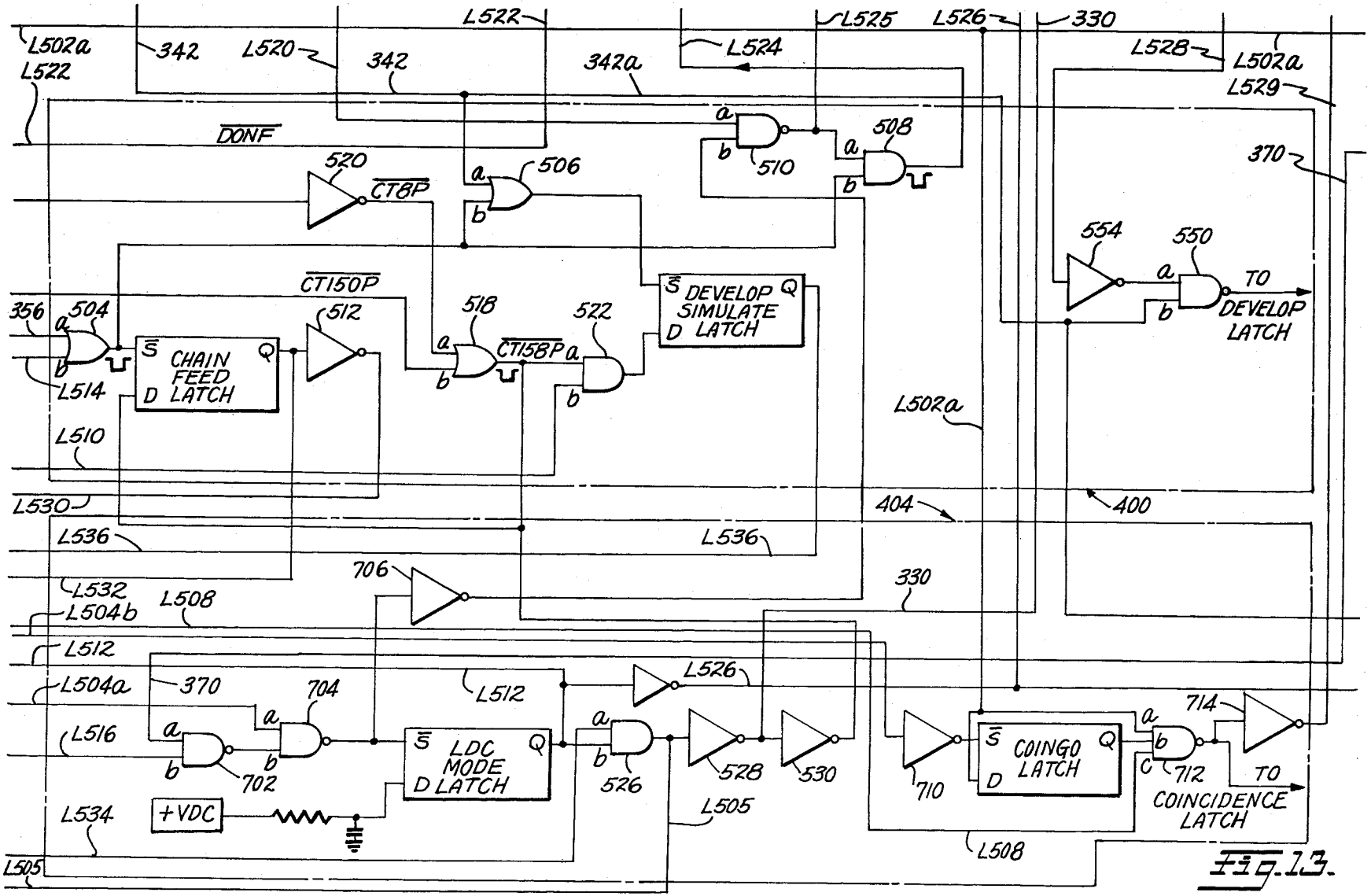
Figure 14:
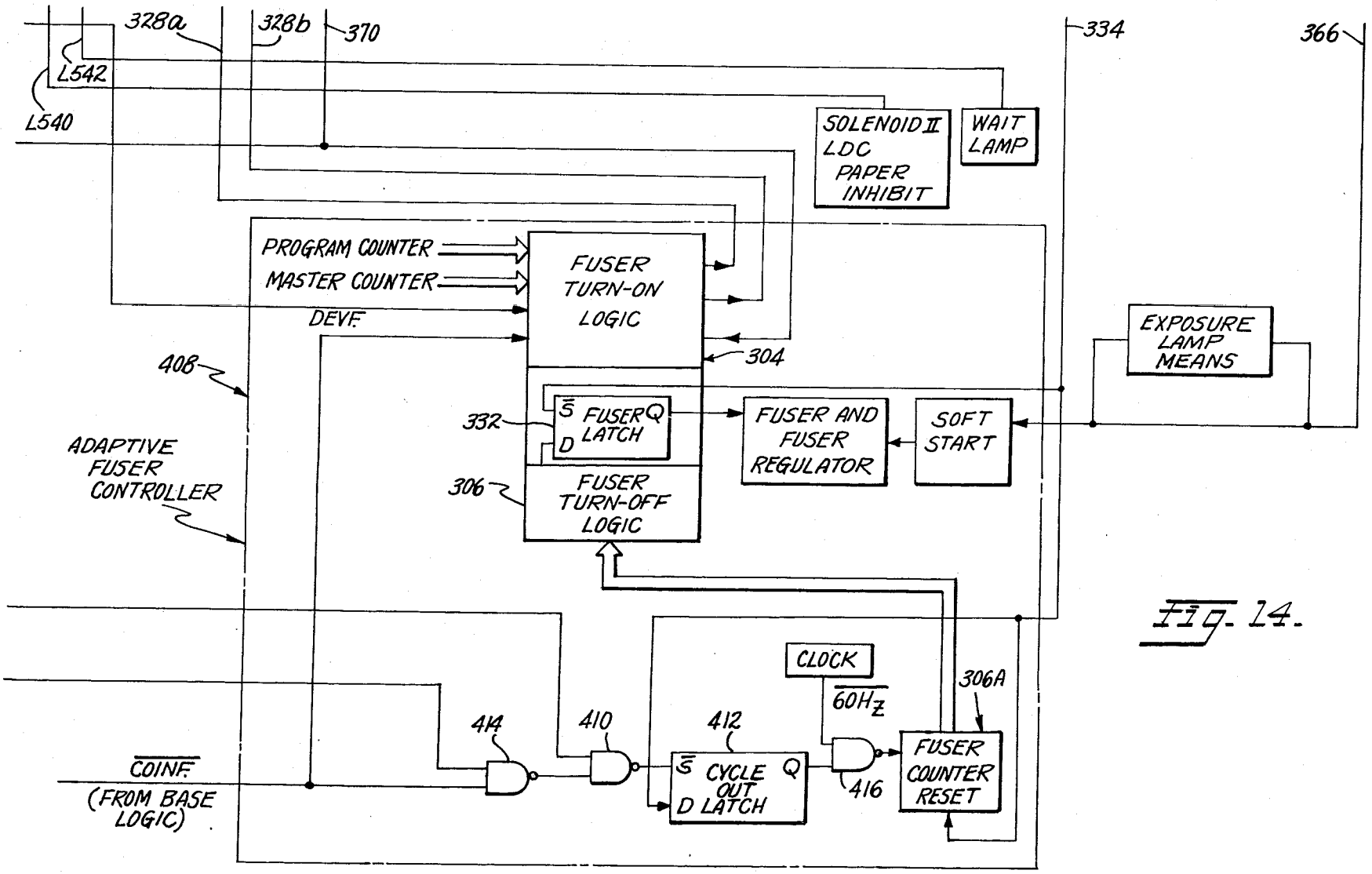

FIGS. 5A and 5B show the LDC/SC timing diagram; FIGS. 5C and 5D show similar diagrams for the LDC/LC Mode of operation; and FIG. 5E shows a timing diagram for the BASE Mode of operation. By comparing these diagrams, it is seen that for all Large Document Copying Modes of operation, the following events occur: insertion of the document in the document feeding means 30 activates the Document Switches, turns on the charge corotron and resets the Master Counter 318. At CT13M, the Scan Latch is set which effectively means that a copy paper feeding solenoid is energized to initiate the copy paper feeding mechanism. (Scanning of the exposure lamp 21 is not needed in the LDC Mode as the fixed optical system is employed. However, the function of feeding the copy paper is controlled by the Scan Latch). At CT16M, the LDC Exposure Latch is set and the exposure lamp is turned on. At CT20M, the copy paper feed solenoid (via the Scan Latch) is deenergized and the Master Counter is reset. CT8M designates the point at which the Develop Latch is set initiating the development process in the development station. At CT141M-SQ2, the Coincidence Latch is set. The Coincidence Latch is set whenever the numbers of copies exposed is equal to the number of copies ordered by the operator on quantity dial 99. The Coincidence Latch will always be set at CT141M-SQ2 in the LDC Mode as all LDC Modes of operation are single copy modes. The Master Counter is also reset at coincidence. After coincidence, the remaining xerographic processes depend upon whether a small cassette or a large cassete is utilized.

For the LDC/SC Mode (FIGS. 5A and 5B) a second counter means, or Program Counter, is run in parallel with the Master Counter. At CT13M (CT13P), the LDC Exposure Latch is turned off which deactivates the exposure lamp. After CT13P, the states of the Master Counter are not utilized throughout Sequence 3 unless a chain feeding mode of operation is initiated by a subsequent feeding of a document by the document feeding means 30. Assuming no subsequent document is fed, only the Program Counter states are significant after CT13P in Sequence 3. The Development Latch within the BASE LOGIC 300 is turned off slightly before CT72P by the copy paper Trailing Edge Switch. The Trailing Edge Switch also initiates the clocking of still a third counter, the Fuser Counter which is utilized strictly to govern the fuser turn-off time period. At CT72P, the Fuser Counter is reset and full fuser turn-on is achieved. At CT80P, a motion sensing circuit is activated which senses the paper motion of the copy paper in its travel from the transfer station to the fuser station. At CT150P, the motion sensing circuit is deactivated. Between counts 150P and 158P, the billing process is activated and completed. If in fact no subsequent documents were fed into the document feeding means before CT158P, the Master Counter would also be at a state of 158M. In this event, the Master Counter is ready to proceed in controlling the power-down functions of Sequence 4. At CT256M-SQ4, the Program Counter is added in series with the Master Counter to provide a single counter having extended capabilities. (The Master Counter as well as the Program Counter are each eight bit counters). At CT1024 (M + P) the machine is powered down.

In the LDC/LC timing sequence, shown in FIGS. 5C and 5D, the Coincidence Latch also resets the Master Counter at CT141M-SQ2. Here, however, there is no second or Program Counter connected to run in parallel with the Master Counter. Thus, in Sequence 3 the fuser is turned on at CT72M, and the motion sensing circuit is activated during CT84M-CT148M. As different sizes of copy paper may be used in the large cassette in the LDC/LC Mode, the LDC LOGIC 302 interrogates the Trailing Edge Switch at CT157M-SQ3 to see if the copy paper is still being fed into the machine. If the copy paper has passed by the Trailing Edge Switch, the copy would be nominally less than 15 inches long (in the direction of copy paper travel through the machine). The billing functions are then started at CT157M-SQ3 and are complete (13) Master Counts later provided the original document has deactivated the Document switches. A Done Latch is reset at CT157M-SQ3 which enables the Exposure Latch to turn off the exposure lamp at CT13M after resetting of the Done Latch. The resetting of the Done Latch also serves to turn off the charge corotron and the Develop Latch.

If the document is still present at CT157M-SQ3, (document nominally greater than 15 inches), the Master Counter is reset and continues clocking into Sequence 4. The Done Latch is now reset by the Trailing Edge Switch, S3, which is deactivated when the copy paper trailing edge passes thereby. The Trailing Edge Switch also turns on the Fuser Counter. As the exact time at which the Trailing Edge Switch is deactivated depends on the size of copy paper used, an X indicates the appropriate Master Counter State as shown in Sequence 4 in FIG. 5C. Again, resetting the Done Latch turns off the Develop Latch and the charge corotron. At X + 13M, the LDC Exposure Latch is reset and the exposure lamp turned off. The Fuser is turned off at CT208F, and the Master Counter, extended by the series addition of the Program Counter continues to clock, shutting down power at 1536 (M + P). In the power-down sequence, the Program Counter does nothing more than extend the range of the Master Counter for power-down purposes, and a larger Master Counter would work as well. In this connection, the Master Counter is not "Free" to control a subsequently fed document until the end of the billing function whether that be at 157M-SQ3 + 13M or X + 13M. In the chain-feed mode of operation one essentially frees the Master Counter at a much earlier time in using the small cassete (FIG. 5A), by employing a second counter, the Program Counter, to control the motion sensing and billing functions. The chain feed control circuit essentially frees the Master Counter after exposure of the first document is complete. The time saved over the conventional LDC/LC Mode of operation is indicated in FIG. 5C with respect to documents less than and greater than 15 inches. A full description of the chain-feed operation is given in the concurrently filed application by W. L. Valentine entitled "Chain-Feed Control Logic for a Multi-Mode Copier/Duplicator".

In describing the Chain Feed Logic 400 and the LDC Logic 302, reference is made to the following tables wherein input and output connections are described.

In the BASE Mode of operation as shown in FIG. 5E, the Master Counter is reset and the exposure lamp is turned on in response to the operator pressing the PRINT button 53. At CT64M the charge corotron is turned on. At CT80M the Master Counter is reset and the scan solenoid is actuated thereby starting the scanning process for the optical elements 21 and 22 as well as the copy paper feeding mechanism. The Develop Latch is set at CT8M-SQ2 thereby starting the development process. If the operator is operating in a single copy run, having set the number 1 in the paper quantity dial 99, the Coincidence Latch is set at CT141M-SQ2, and the machine procedes immediately to CTOM-SQ4, the Master Counter being reset at coincidence. At CT52M-SQ4 the Develop Latch is reset and the developer is turned off. The fuser is turned on to full power at CT72M-SQ4 and the Fuser Counter clocks to CT184F before shutting off the fuser. In the BASE Mode of operation only the small paper cassette is utilized, and thus the fuser is turned on and off at fixed times in relation to other machine fuser times. Between CT84M-SQ4 and CT148M-SQ4 the copy paper motion sensing unit is activated and billing takes place between CT148M-SQ4 and CT157M-SQ4. The machine then enters Sequence 5, and powers-down at CT1024(M + P). If the operator orders more than one copy of a document original a multiple copy run takes place in the BASE Mode as indicated in Sequence 3 in FIG. 5E. The Coincidence Latch is then set only after the last copy of the multiple copy run. Upon setting the Coincidence Latch the machine enters Sequence 4 as in the single copy run case above.

4. Detailed Logic Description —General

A detailed description of the LDC LOGIC 302 of FIGS. 6–11 is found in copending application Ser. No. 528,163, filed Nov. 29, 1974. The description set forth below emphasizes those features of the multi-mode copier electronics which are particularly germane to the Cycle-Out Control Circuit (FIG. 13) of the instant invention.

In describing the Cycle-out Logic 404 and the LDC Logic 302, reference is made to the following tables wherein input and output connections are described.

TABLE 2

| INPUTS LINES FROM BASE LOGIC TO LDC LOGIC (See FIGS. 6 and 9) | |
|---|---|
| $\overline{\text{DEVF}}$ [LD2] | This input provides the status of the Develop Latch located in the BASE LOGIC; it exhibits a logical "O" to enable the developing means through multiplexer 122M. |
| $\overline{\text{MAIN DRIVE}}$ | This input provides the status of the Main Drive |

TABLE 2-continued

| INPUTS LINES FROM BASE LOGIC TO LDC LOGIC (See FIGS. 6 and 9) | |
|---|---|
| [LD3] | Latch (not shown) in the BASE LOGIC; it exhibits a logical high when the main drive M is not running and logical "O" when it is running. |
| SCAN [LD4] | This input from BASE LOGIC provides a Scan Signal to the Scan Solenoid Mux 124M in the BASE Mode of operation. It is a logical "1" to activate the scanning means in the BASE Mode. |
| EXPOF [LD5] | This input provides the status of the Base Expose Latch located in the BASE LOGIC. It exhibits a logical "1" when enabling the exposure means. |
| PAPSW [LD6] | This input provides the status of the paper sensing switch. When sufficient copy paper is present it exhibits a logical "1". |
| PRINT [LD7] | This input provides the status of the PRINT Button 53 to the multiplexer 123M. During actuation of the PRINT Button 53, it exhibits a logical "O". |
| CT 13M, 4M, etc. [LD9, LD11] | This input refers to count signals corresponding to 13, 4, etc. of the master counter, provided in the form of a high or logical "1" signal. |
| DEVF [LD10] | This input provides the status of the develop Latch located in the BASE LOGIC. It is the inverse of $\overline{\text{DEVF}}$ mentioned above; thus when developer C actuating signals are provided by the Development Latch this goes to a logic "1" or high from logical "O". |
| HOME SW [LD12] | This input provides the status of the Home Switch S1. In the actuated state, i.e., when the scanning elements 21–22 are at the home position, it exhibits a logical signal "1". |
| 8M [LD13] | This signal is a binary signal from the Master Counter which is high for eight counts and low for the next eight counts and so forth. It is used to provide a slight delay (8 counts) before actuation of the Scan Latch in mode changing operations. |
| $\overline{\text{HOME SW}}$ [LD14] | This input provides the status of the Home Switch S1. It is the inverse of the above i.e., when the scanning elements 21–22 have left the home position the Home Switch S1 is deactivated thereby providing a logical "1" signal via this line. |
| $\overline{\text{INITIAL}}$ [LD15] | This input provides the initializing signals developed in the BASE LOGIC. When $\overline{\text{INITIAL}}$ level is a logical "O", a power up sequence is occurring and this signal is used to initialize the elements contained in the LDC LOGIC. |
| CHARGEF [LD16] | This input provides the status of the charge Latch located in the BASE LOGIC. A logical "1" indicates the activation of the charging means E of the xerographic machine. |
| COINF. $\overline{\text{DEVF}}$. MPX [LD17] | This input provides the composite status of the two named latches. It exhibits a logical "1" when the Coincidence Latch (COINF) is set and the Development Latch is not set. Both latches are located in the BASE LOGIC. |
| COINF SIGNAL [LD17a] | This is the Coincidence Signal from the BASE LOGIC which is high at CT 141M whenever the copier/duplicator is in a single copy run (LDC Modes) or the last copy of a multiple copy run. |
| PROG CLK [LD18] | This input provides a signal associated with the incrementing of the Program Counter. It exhibits a logical "1" when the counter is being incremented; and reverts to a logical "O" upon termination of each incrementing signal. The Program Counter is used to keep track of the number of copies made in a Multiple Copy, BASE Mode run and is incremented at CT141M-SQ2. |

TABLE 3

| OUTPUT LINES FROM LDC LOGIC (See FIGS. 8 and 11) | |
|---|---|
| ADD PAPER [00] | This output is applied to the ADD PAPER indicator to advise as to a copy paper supply run out condition. |
| $\overline{\text{COINF SET}}$ [01] | This output is applied to the Base Logic. It goes to logical "O" setting the Coincidence latch in the Base Logic. |
| LDC BILLING [02] | This output signal is applied to an LDC billing meter, the details of which are shown in the above-mentioned copending application, Serial No. 393,545. |
| EXPOF MPX (PRINT DISABLE) [161] | This output from the multiplexer 121M is used to actuate or energize the exposure means when the document original being scanned must be image exposed on to a photoreceptor. This signal also disables the PRINT button in the BASE Mode oper- |

TABLE 3-continued

| OUTPUT LINES FROM LDC LOGIC (See FIGS. 8 and 11) | |
|---|---|
| | ation. |
| DEVF-MPX [162] | This output from the multiplexer 122M controls the developing means. With DEVF MPX of logical "1" the developing means is not on and when it switches to logical "O", the developing means is turned on. |
| LDC DEV BIAS RESET MPX [163] | This output from the 110 123M is applied to the Bias Latch (not shown) of the machine and provides a normal bias level. |
| SCAN MPX [164] | This output from the multiplexer 124M is used to selectively energize the scanning solenoid means in the machine, as well as the copy paper feed solenoid. |
| DONE-L [04] | This output signal signifies that the machine has completed a copy cycle while operating in LCD Mode. It is fed to the Base Exposure Latch in BASE LOGIC 300. |
| EXP MPX [165] | This output signal is applied to the exposure means to selectively maintain it in a non-actuated state. It is also applied to the Base input of multiplexer 121M. |
| MAIN DRIVE MPX [166] | This output from the multiplexer 125M is used to enable the main drive M. |
| FUSER MPX [334] | This output from the multiplexer 127M is applied to the Fuser Latch to selectively energize the fuser element. |
| CHARGE MPX [168] | This output from the multiplexer 128M is applied to the charging means to selectively energize the charge corotron. |
| LDC [07] | This output signifies the operating mode of the machine, it exhibits a logical "O" to denote LDC operation. |
| LDC EXPOF [08] | This output, when a logical "O", resets the BASE Mode Exposure Latch which normally controls the jam detection timing. Since the jam detection requirements of the LDC Mode are different from the BASE Mode, the Exposure Latch must be reset. |
| DEV SET LDC [09] | This output, when a logical O, sets the Developer Latch at the proper time in the LDC Mode, since this time is different than the time required for the BASE Mode. The BASE Mode signal is inhibited by the LDC output which is logical "O" when the machine is in the LDC Mode. |
| LDC 13 + COIN RESET [010] | This output when a logical "O", sets the Coincidence Latch at a count of 13 and Done Latch set signifying that the machine is not processing a piece of copy paper. This output is used to set the Coincidence Latch to logical "1", thereby cycling out the machine if copy is not started. |
| LDC MASTER CTR CLR [012] | This output, when logical "1", signifies that the MASTER COUNTER is conditioned to count and when logical "O", the counter is cleared and held at a count of zero. |
| HOME + LDC [013] and PWR INIT +LDC [014] | These signals are actually LDC (the complement of LDC). They perform the function of disabling the HOME Switch LATCH (not shown) while in the LDC Mode and simulating a power initialize pulse when the machine is changed from the BASE Mode to the LDC Mode. |
| 141 DISABLE [015] | This signal, when a logical "O", inhibits the 60Hz clock signal to the Program Counter Latch once coincidence has been set. |
| LDC EXT SHUT DN [016] | This signal, when a logical "O" is used to power-down the machine in the LDC/LC Mode. The output provided represents a timing count in the Master Counter/Program Counter which extends the shutdown time (e.g., 26 seconds) from a shorter shut-down (e.g., 16 seconds) used in the BASE Mode. |
| LDC ONE SHOT CLR [06] | This output, when a logical "O" signifies that the One Shot 213 has been triggered and this causes the resetting of the Master Counter. |

TABLE 4

| SIGNAL EXCHANGE BETWEEN LDC LOGIC AND CHAIN FEED LOGIC | |
|---|---|
| DEVF SIGNAL [L502,502a L506] | This signal comes from the "Q" node of the Develop Latch in the BASE LOGIC 300 and is used to condition the Scan Latch via NAND gate 502 and line L506 to be actuated only if the development function has terminated e.g., the DEVF signal is low. The signal is also passed along line L502a to reset the Coin Go Latch. |
| LDC MODE SWITCH | This signal comes from the LDC Mode Switch via |

TABLE 4-continued

| | SIGNAL EXCHANGE BETWEEN LDC LOGIC AND CHAIN FEED LOGIC |
|---|---|
| SIGNAL [L504] | the pull-up network 101A. It forms an enable to NAND gate 704 to set the LDC Mode Latch. |
| LDC MODE LATCH . $\overline{\text{JAMF}}$ [L505] | This signal comes from AND gate 526 (FIG. 13) and is high when the LDC Mode Latch is set and no jams exist. |
| PROG CLK SIGNAL [L508] | This signal is high, logical "1", for one clock pulse whenever there is a coincidence i.e. the Program Counter keeps track of the number of copies made in the BASE Mode multiple copy runs and is incremented once for all LDC Mode operations at CT141M. It is used to force coincidence in changing modes from BASE, multiple copy runs to LDC Mode. |
| $\overline{\text{CT20M}}$ [L510] | This signal is a low pulse at CT20M and is used to reset the Develop Simulate Latch. |
| LDC MODE LATCH [L512] | This signal is high whenever the LDC Mode Latch is set. |
| COINF SET [LD18, L514] | In the LDC/SC Mode, this signal is fed to OR gate 504 to provide a negative going pulse at coincidence (CT141M-SQ2) which is used in connection with the resetting of the Done Latch and the setting of the Develop Simulate Latch. |
| $\overline{\text{INITIAL}}$ [LD15, L516] | This signal is fed to NAND gate 702 in the Cycle-Out Logic 404 to condition the LDC Mode Latch. |
| FAILSAFE TIMER [L518] | This signal initiates the failsafe timer which times the scanning of the optical carriage from the Home Position to the End of Scan Position. |
| LARGE CASSETTE SWITCH SIGNAL [356] | This signal comes from the Large Cassette Switch via pull-up network 101D. It is used to inhibit the setting of the Chain Feed Latch in Large Cassette modes. |
| TRAILING EDGE SWITCH SIGNAL [342,342a] | This signal is fed to OR gate 506 to condition the Develop Simulate Latch, and to NAND gate 550 to condition the Develop Latch. |
| END OF SCAN SIGNAL [L520] | This signal is low when the scanning carriage is at the End of Scan (EOS) Position and forces the resetting of the Done Latch until carriage reaches EOS. |
| $\overline{\text{DONEF}}$ SIGNAL [L522] | This signal is fed to NAND gate 524 to allow actuation of the Scan Latch for a second copy before completion of the development process of a first copy in a Chain Feed Mode of operation. |
| DONE RESET [L524] | This signal is used to reset the Done Latch at Coincidence in the LDC/SC Mode of operation. |
| $\overline{\text{EOS}}$ . LDC MODE [L525] | This signal is fed to inverting gate 118 and is low whenever the carriage is at the EOS position and the LDC Mode Latch is set. |
| $\overline{\text{LDC MODE LATCH}}$ SIGNAL [L526] | This signal is low whenever the LDC Mode Latch is set. It is fed to NAND gate 216. |
| LDC MODE LATCH . JAMF SIGNAL [330] | This signal is low whenever the LDC Mode Latch is set and no jams are present. It is fed to the "select" or "C" terminals of the multiplexers 121M–128M. |
| DONE . LDC MODE [L528] | This signal is used to reset the Develop Latch when the Done Latch is reset in the LDC Mode via NAND gate 550. |
| $\overline{\text{LDC MAS CTR CLR}}$ SIGNAL [L529, 012] | This signal originates from NAND gate 712 when the Coin Go Latch of the Cycle-Out Logic 404 is set to force a coincidence and reset the Master Counter in mode changing operations. |
| PAPER FEED INHIBIT SIGNAL [L540] | This signal is used to inhibit the feeding of copy paper when the scanning carriage is not in the End of Scan position, and the LDC Mode Latch is set. |
| WAIT SIGNAL [L542] | This signal is used to energize the "wait" visual indication means 50 when the Done Latch is set or when the machine is in the LDC Mode but the scanning carriage is not at the End of Scan position. It is also energized when the paper supply is depleted. |
| FUSER SIGNALS [L328a, L328b, 370] | These signals connect the Fuser Turn-On Logic Circuit 304 of the Adaptive Fuser Controller to the Fuser and Exposure multiplexers. |

In the LDC LOGIC 302 shown in FIGS. 6–11, the gate and circuit designates remain the same as those in the above-mentioned copending application. Several simplifications have been made to the drawing, however for ease of understanding the instant Cycle-Out Logic Circuit. In particular, only pull-up circuit 101A has been shown in detail although all such circuits 101A, B, C, etc., are identical. In addition, the multiplexers have been indicated in block form only as they are all identical to the multiplexer shown in detail in FIG. 16A. Finally, the latches are shown in block form and are all identical to the latch shown in detail in FIG.

16A. Finally, the latches are shown in block form and are identical to the latch shown in detail in FIG. 16D. The latches are operated in the R/S (reset/set) mode, and for simplicity, the memory reset signal (MR) has not been drawn. The memory reset signal is supplied by the Initialization Circuit 320 in a conventional manner.

In general, key xerographic functions are controlled by actuating signals fed through the 2:1 multiplexers 121M–128M. The multiplexers are conditioned to pass through the logical equivalent of a selected input signal at terminal A or B depending upon whether the copier is in the LDC Mode or BASE Mode respectively. The C or select terminal (shown on multiplexers 121M and 128M) serve to select which input signal is fed to the multiplexer output. The signal feeding the select terminal comes from the LDC Mode Latch (FIG 13) via NAND gate 526, inverting gate 528 and line 330. A high signal, logical 1, indicates the LDC Mode. In incorporating the instant invention into the LDC LOGIC 302, a key difference in the instant circuit over that of the afore-mentioned copending application involves replacing the dependency of most logic components, particularly the mulfiplexers, from the LDC Mode Switch, S6, to the LDC Mode Latch. Other features of the LDC LOGIC 302 (FIGS 6–11) will become clear in connection with the description of the Cycle-Out Control Circuit described below.

BASE-to-LDC Mode Change

The LDC Mode Latch

In order to change the copier/duplicator from the BASE Mode to the LDC Mode, the operator moves lever arm 31 in a clockwise direction thereby actuating the LDC Mode Switch. Actuation of the LDC Mode Switch (from BASE to LDC Mode) removes the ground from pull-up network 101A so that a high input signal is applied to the *a* input of NAND gate 704 (FIG. 13) via lines L504 and L504*a*. Mode change does not automatically take place, however, as the *b* input to NAND gate 704 is controlled by the output of NAND gate 702. The output of NAND gate 702 must be high to feed a high signal to the *b* input of NAND gate 604 thereby setting the LDC Mode Latch. To obtain a high output from NAND gate 702 one or both of the inputs must be low. The *a* input is supplied by the EXP MUX signal via line 370 which is low whenever the exposure lamp is de-energized (LDC or BASE Mode). The *b* input to NAND gate 702 is the $\overline{\text{INITIAL}}$ Signal via the BASE LOGIC and lines LD15 and L516. The $\overline{\text{INITIAL}}$ Signal is low only during a power-up sequence and cannot be low during any BASE Mode exposure essentially because the $\overline{\text{EXP MUX}}$ signal is fed to the Print Disable MUX 121M which keeps the $\overline{\text{INITIAL}}$ Signal high during BASE Exposure (maintaining $\overline{\text{INITIAL}}$ high is equivalent to disabling the PRINT button). Thus, in all events, a low input to the *a* or *b* input of NAND gate 702 is supplied only if exposure is off, namely the EXP MUX Signal is low. This constraint essentially limits the setting of the LDC Mode Latch to Sequence 5 in the BASE Mode (FIG. 5E) when the exposure goes off. Inasmuch that the LDC Mode Latch controls the multiplexers 121M–128M which in turn control the key xerographic operation, the Cycle-Out Logic 404 essentially delays any BASE-to-LDC Mode Charge as initiated by the operator so that the logical mode change takes place in Sequence 5 of the BASE Mode. In practice, if the operator moves the lever 31 during a BASE Mode Exposure, the feeding head will physically move into the LDC position, but the machine electronics (multiplexers) will not be switched to the LDC Mode until Sequence 5 when the exposure goes off and the LDC Mode Latch is set. If the operator moves the lever 31 while exposure is off, and the machine is in standby, the Mode Change Switch S5 (roll-over switch, will be actuated and triggers the initialization circuit to supply a low $\overline{\text{INITIAL}}$ Signal.

The significance of delaying the mode change until Sequence 5 is readily seen in that one desires to finish key xerographic function of the copy in process, including the copy paper jam sensing and billing functions. The earliest time at which such key events are completed is CT157M-SQ4 when the BASE Exposure Latch is reset. The Fuser Counter is at this time already clocking and will independently turn-off the fuser at CT184F irrespective of any Master Counts resetting the LDC Mode Operations

Non-Last Copy Run

Assume now that the BASE Mode is in a Multiple Copy Run wherein several copies of a single document original are to be made and the copier/duplicator is not making the last copy. In this event it is desirable to get out of the multiple copy cycle at the earliest opportunity completing just the copy in process, but no additional copies. To achieve this end, the Cycle-Out Logic forces a coincidence at CT141-SQ3 regardless of how many copies are left to be made in the multiple copy run.

To force the coincidence, the operation, as before, moves the lever 31 into the LDC Mode thereby placing a high signal on line L504 via pull-up network 101A. The high signal is passed along lines L504 and L504*b* to an inverting gate 710 (FIG. 13) thereby feeding a low signal to the $\overline{\text{S}}$ mode of a CoinGo Latch. The D node of the CoinGO Latch is fed by the Develop Signal, DEVF, via lines L502 and L502*a*. DEVF is always high in Sequence 3 of the BASE Mode, and thus the CoinGO Latch will set whenever the LDC Mode Switch is actuated. The high Q output of the set CoinGO Latch is fed to a *b* input terminal of a NAND gate 712. The *a* input of NAND gate 712 is supplied with the high DEVF signal and the c input is fed by the PROG CLK Signal via lines L508. Thus, upon CT141M-SQ3, the PROG CLK high pulse drives the output of NAND gate 712 low, and the low signal is fed to the $\overline{\text{S}}$ node of the Coincidence Latch in BASE LOGIC 300. The Coincidence Latch is thereby set at CT141M-SQ3 even if additional copies were originally ordered by the operator (via dial 99) in the Multiple Copy Run of the BASE Mode of operation. The output of the CoinGO Latch also serves to reset the Master Counter via inverting gate 714 and lines L529 and 012. Thus, the Master Counter is reset and Sequence 4 of the Base Mode is entered. As before, the setting of the LDC Mode Latch, which marks the control logic entry into the LDC Mode, takes place at CT157M-SQ4.

Last Copy Run

If one is running in the single copy BASE Mode or the last copy of a Multiple Copy Run, the LDC Mode Latch is set at CT157M-SQ4 as coincidence will have been set at CT141M-SQ2 or SQ3. As before the delayed switch of the multiplexer 121M-128M permits key photographic functions to take place and allows copy paper jam sensing and billing to be achieved. In effect all Master Counter controlled functions must be completed before the logic is ready to switch to the LDC Mode, as the LDC Mode uses the Master Counter to control its operations.

Carriage Position

The operator may move the LDC lever 31 at any time during a BASE Mode operation. In order for the machine to be mechanically in the LDC mode, the scanning carriage or scanning elements 21 and 22 must be locked at the End of Scan position.

Assume first that the scanning carriage is not at the End of Scan position but is at the Home Position when the operator makes the BASE-to-LDC Mode Change. In reference to FIG. 9, pull-up network 101H supplies a high signal along line LD12 to the *b* input of NAND gate 116. The *a* input of NAND gate 116 is fed to a high signal from inverting gate 118 which receives a low signal from NAND gate 510. The two inputs to NAND gate 510 are both high as the machine is not in the End of Scan position (line L520 high), and the LDC Mode Switch is activated (NAND gate 704 output low and inverting gate 706 output high). The C input of NAND gate 116 is supplied with the binary 8M signal which is high for eight Master Counter Counts and low for the next eight counts, etc. Thus, no later than eight Master Counter clock pulses after the LDC Mode Switch is activated, NAND gate 116 exhibits a low output. This low output signal is fed to NOR gate 121 (FIG. 10) producing a high signal therefrom which is fed to the A input terminal (LDC input terminal) of the Scan Solenoid MUX 124M. The A input to the Scan Solenoid MUX 124M is only controlling if the LDC Mode Latch is set. In practice, during a BASE Mode run, End of Scan is reached approximately 14–20 Master Counter counts after coincidence (CT141-SQ2) and flyback is complete when the Home position is reached approximately 30–50 Master Counter counts after coincidence. Consequently, the scanning carriage remains in the Home position until the LDC Mode Latch is set. Upon setting the LDC Mode Latch, the high input to terminal A of multiplexer 124M produces a high SCAN MPX signal along line 164 to actuate the scan solenoid and bring the scanning carriage from the Home position to the End of Scan position. The scanning carriage is mechanically locked into the End of Scan position as is required for the fixed optical system of the LDC Mode of operation.

During the mode-change scanning operation, it is not desired to feed copy paper simultaneously with the carriage movement as is done in the BASE Mode. To inhibit such copy paper feeding, a low EOS . $\overline{\text{LDC}}$ Mode Switch Signal from NAND gate 104 via line L540*a* is fed to inverting gate 113 (FIG. 10), and a high signal is thereby fed to inhibit the actuation of copy feed solenoid II via line L540 (FIG. 14).

Once the carriage reaches the End of Scan position, it is mechanically locked into place. The End of Scan Switch is then actuated which produces a low $\overline{\text{EOS}}$ Signal at the output of pull-up network 101B. This low signal is fed to NAND gate 104 driving its output high. The high output is inverted by inverting gate 113 and the low output of inverting gate 113 allows copy paper feeding for subsequent settings of the Scan Latch.

If the scanning carriage is neither at the Home position nor at the End of Scan position during mode change, it must be scanning the document or in a flyback mode. In either event, a high signal is fed from pull-up network 101G to the *b* input of NAND gate 117. The *a* input of NAND gate 117 is fed by a high signal from inverting gate 118 which is fed by a low signal from NAND gate 510. A low signal from NAND gate 510 occurs if both its inputs are high. The *a* input to NAND gate 510 is high as this signal comes from the output of pull-up network 101B via line L520 which is high assuming the carriage is not at the End of Scan position. The *b* input to NAND gate 510 comes from the output of inverting gate 706 which is fed by NAND gate 704. In order to have NAND gate 704 deliver the requisite low output signal to inverting gate 706, both of its inputs must be high. The *b* input to NAND gate 704 is high as the LDC Mode Switch is in the LDC Mode position. The *b* input to NAND gate 704 is high as either the exposure is off EXP MUX signal low or the Initialization Signal is low e.g. one is initializing.

The two highs to NAND gate 117 drives its output low, and the low output is fed to NOR gate 190 driving its output high. The high output from NOR gate 190 is fed along line 012 to reset the Master Counter. In addition, the low output of NAND gate 117 is fed via line L518 to start the Failsafe timer 608. The failsafe timer is essentially an independent timer that resets the JAM Latch if the scanning carriage is off the Home or off the End of Scan position for longer than a preset time interval, i.e., 3–6 seconds. If there is no carriage malfunction, the carriage will reach either the End of Scan position and be mechanically locked in place or else the carriage will return to the Home position. If the carriage returns to the Home position the scanning solenoid will be actuated via NAND gate 116, NOR gate 121 Scan Solenoid Mux 124M as explained above.

LDC Mode-to-BASE Mode

If the operator moves lever 31 in a counterclockwise direction the feeding head is moved from the LDC Mode position to the BASE Mode position. It is desired to maintain the logic circuitry in the LDC Mode, however, until the machine is powered-down at the end of Sequence 4 (FIGS. 5A and 5C). This result is achieved by logically equating the change of the LDC Mode Switch from the LDC to the BASE Modes to the closure of the Document Switches indicating no document present. Thus, the output of AND gate 102*a* goes low upon a LDC-to-BASE Mode change and this low forces the output of NAND gate 211 high just as if the document had physically left the Document Switches S7 and/or S8. Note however, that the LDC Mode Latch is still set with its Q output high and thus the remaining logic functions are carried out as usual in the LDC Mode (e.g. FIGS. 5A–5D).

Certain modifications and improvements of the instant invention will be apparent to those of skill in the art and the claims are intended to cover all such modifications and improvements which do not depart from the spirit or scope of the invention.

I claim:

1. A cycle-out logic system for a copier/duplicator having a moving optical system for operation in a first mode of operation and a fixed optical system for operation in a second mode of operation, and means including switching means for changing between the first and second modes comprising:

means for enabling said copier/duplicator to remain in either one of said first and second modes of operation upon the actuation of said means for changing between said first and second modes until a pre-determined machine event in said one mode of operation;

said switching means providing a first mode signal and a second mode signal corresponding respectively to said first and second modes of operation and said means for enabling said copier/duplicator to remain in said first mode upon actuation of said switching means comprises:

a first logic circuit;

means for connecting said first logic circuit to receive said first and second mode signals from said switching means;

means for connecting said first logic circuit to receive at least one additional signal corresponding to said predetermined machine event in said first mode of operation; and means for connecting said first logic circuit to provide an output signal upon receipt of said second mode signal and at least one additional signal, said output signal effective to switch said copier/duplicator from said first mode of operation to said second mode of operation.

2. A cycle-out logic system for a copier/duplicator as recited in claim 1 wherein said copier/duplicator is a photocopy machine having a document exposure means and said one additional signal corresponds to the deactuation of said document exposure means.

3. A cycle-out logic system for a copier/duplicator as recited in claim 1 wherein said first logic circuit comprises a bistable latch for providing a first output signal for said first mode of operation of said copier/duplicator and a second output signal for said second mode of operation.

4. A cycle-out logic system for a copier/duplicator as recited in claim 1 wherein said copier/duplicator has a document switch responsive to the presence and absence of documents fed into said copier/duplicator and providing document present and document absent signals accordingly, and said means for enabling said copier/duplicator to remain in said second mode of operation upon actuation of said switching means comprises:

a. a second logic circuit, b. means for connecting said second logic circuit to receive said first and second mode signals from said switching means, c. means for connecting said second logic circuit to receive said document present and document absent signals, and d. said second logic circuit providing a predetermined output signal irrespective of whether said first mode signal is received or said document absent signal is received, said second logic circuit thereby simulating the absence of a document upon actuation of said switching means in changing from said second mode of operation to said first mode of operation.

5. A cycle-out logic system for a copier/duplicator as recited in claim 1 wherein said copier/duplicator has a document switch responsive to the presence and absence of documents fed into said copier/duplicator and providing document present and document absent signals accordingly, and said switching means provides a first mode signal and a second mode signal corresponding to said first and second modes of operation, respectively, and said means for enabling said copier/duplicator to remain in said second mode of operation upon actuation of said switching means comprises logic circuit means responsive to said document present and document absent signals and responsive to said first and second mode signals, said logic circuit means providing a predetermined output signal irrespective of whether said first mode signal is received or said document absent signal is received, said logic circuit means thereby simulating the absence of a document upon actuation of said switching means in changing from said second mode of operation to said first mode of operation.

6. A cycle-out logic system for a copier/duplicator as recited in claim 4 wherein said copier/duplicator is a photocopy machine having document exposure means and wherein said predetermined machine event corresponds to the deactuation of said exposure means in changing from said first mode of operation to said second mode of operation.

7. A cycle-out logic system for a copier/duplicator as recited in claim 6 wherein said photocopy machine is powered-down after deactuation of said exposure means and said predetermined event corresponds to the power-down event in changing from said second mode of operation to said first mode of operation.

8. A cycle-out logic system for a copier/duplicator as recited in claim 7 wherein said photocopy machine is a xerographic machine.

9. A cycle-out logic system for a copier/duplicator as recited in claim 1, wherein said switching means is manually operable.

10. A method of delaying a mode change in a multimode copier/duplicator having first and second modes of operation and having a large document copying feeding head, comprising the steps of:

manually initiating a mode change between said first and second modes of operation, comprising moving said large document copying feeding head between first and second mode positions; and electronically and automatically delaying said mode change until a pre-determined machine event takes place.

11. A method of delaying a mode change in a multimode copier/duplicator as recited in claim 10 wherein said copier/duplicator is a photocopy machine having document exposure means and wherein said delaying step comprises sensing the deactuation of said document exposure means in changing from a first mode to a second mode of operation.

12. A method of delaying a mode change in a multimode copier/duplicator as recited in claim 11 wherein said copier/duplicator has a power-down machine event and wherein said delaying step comprises sensing the machine power-down event in changing from a second to a first mode of operation.

13. A cycle-out logic system for a copier/duplicator having a moving optical system for operation in a first mode of operation and a fixed optical system for operation in a second mode of operation and means including switching means for changing between the first and second modes comprising:

means for enabling said copier/duplicator to remain in either one of said first and second modes of operation upon the actuation of said means for changing between said first and second modes until a pre-determined machine event in said one mode of operation;

said switching means providing a first mode signal and a second mode signal corresponding respectively to said first and second modes of operation;

said means for enabling said copier/duplicator to remain in said one of said first and second modes of operation upon actuation of said switching means comprising:

a logic circuit;

means for connecting said logic circuit to receive said first and second mode signals from said switching means;

means for connecting said logic circuit to receive at least one additional signal corresponding to said pre-determined machine event in said one of said first and second modes of operation; and means for connecting said logic circuit to provide an output signal upon receipt of said mode signal corresponding to the other of said first and second modes of operation and at least said one additional signal, said output signal being effective to switch said copier/duplicator from said one of said first and second modes of operation to the other of said first and second modes of operation.

14. A cycle-out system for a copier/duplicator as recited in claim 13, wherein said copier/duplicator is a photocopy machine having a document exposure means and said one additional signal corresponds to the deactuation of said document exposure means.

15. A cycle-out logic system for a copier/duplicator as recited in claim 14, further including a document copying feeding head and means for supporting said feeding head for movement between first and second mode positions, and wherein said switching means is actuated by moving said head between said positions.

* * * * *